US010144117B2

(12) United States Patent
Khristyuchenko et al.

(10) Patent No.: US 10,144,117 B2
(45) Date of Patent: Dec. 4, 2018

(54) LOAD INDUCED MECHANISM SYSTEM

(71) Applicants: Oleg Aleksandrovich Khristyuchenko, Burnsville, MN (US); Lynn Alyson Khristyuchenko, Burnsville, MN (US)

(72) Inventors: Oleg Aleksandrovich Khristyuchenko, Burnsville, MN (US); Lynn Alyson Khristyuchenko, Burnsville, MN (US)

( * ) Notice: Subject to any disclaimer, the term of this patent is extended or adjusted under 35 U.S.C. 154(b) by 434 days.

(21) Appl. No.: 13/890,871

(22) Filed: May 9, 2013

(65) Prior Publication Data

US 2014/0331825 A1 Nov. 13, 2014

(51) Int. Cl.

| | |
|---|---|
| ***B25B 7/12*** | (2006.01) |
| ***B25B 7/04*** | (2006.01) |
| ***B25B 7/18*** | (2006.01) |
| ***B25B 7/10*** | (2006.01) |
| ***B25B 7/08*** | (2006.01) |
| *B25B 7/14* | (2006.01) |

(52) U.S. Cl.

CPC ..... *B25B 7/18* (2013.01); *B25B 7/08* (2013.01); *B25B 7/10* (2013.01); *B25B 7/12* (2013.01); *B25B 7/14* (2013.01)

(58) Field of Classification Search

CPC ..... B25B 7/12; B25B 7/10; B25B 7/18
USPC ..... 81/300–427.5
See application file for complete search history.

(56) References Cited

U.S. PATENT DOCUMENTS 508,022 A * 11/1893 Kamohaus ..... B23D 29/023 30/250
512,086 A * 1/1894 Ashcraft ..... B25B 7/14 294/99.2
1,367,711 A * 2/1921 Nortwed ..... B25B 7/12 81/127
1,546,139 A * 7/1925 Leveque ..... B25B 5/06 81/365
1,915,404 A * 6/1933 Clifton ..... B25B 7/12 30/188
2,084,633 A * 6/1937 Erickson ..... B25B 7/02 81/365
2,595,368 A * 5/1952 Plautz ..... B25B 7/10 81/365
2,906,155 A * 9/1959 Miller ..... B25B 7/10 30/181
3,202,022 A * 8/1965 Lothaire ..... B25B 7/10 81/134
3,224,303 A * 12/1965 Giroux ..... B25B 7/00 81/343
3,253,487 A * 5/1966 Bentley, Jr. ..... B25B 7/12 81/314
3,572,192 A * 3/1971 Juras ..... B23D 29/026 30/189
4,890,520 A * 1/1990 Vassiliou ..... B25B 7/04 81/365

(Continued)

OTHER PUBLICATIONS

"Heyco Original Strain Relief Bushing Assembly Pliers Instructions and Spare Parts", pp. 4-23 and 4-24, http://www.heyco.com/Strain_Relief_Bushings/pdf/4-23&4-24.pdf.

*Primary Examiner* — Bryan R Muller

(57) ABSTRACT

A mechanism system can include a load responsive component, a pivot point coupled to the load responsive component, and a mechanism, coupled to the load responsive component, configured to engage when the load responsive component moves and configured to induce a first ratio of movement and a second ratio of movement.

6 Claims, 17 Drawing Sheets

(56) References Cited

U.S. PATENT DOCUMENTS 5,570,510 A * 11/1996 Linden ..... A01G 3/0251
30/192

* cited by examiner

LOAD INDUCED MECHANISM SYSTEM

FIELD OF THE INVENTION

The field of the invention is mechanical devices. More specifically, the invention relates to selectively engaging a mechanism system within a mechanical device.

BACKGROUND OF THE INVENTION

Mechanical tools are used by people around the world for increasing the effectiveness of human ability and facilitate nearly every modern convenience. Tools like pliers, nut crackers, winches, car jacks, wire strippers, scissors, and nail clippers are regularly used to manipulate objects in ways that human hands are not capable of. These tools can allow delicate manipulation of objects or manipulation of objects under extreme forces.

Many of the mechanical tools that provide mechanical advantage are fulcrum based tools. The fulcrum based tool concentrates the force that a user is able to apply. Fulcrums operate when force is applied at different distances from a pivot point and convert a long motion of small force into a shorter motion of larger force. Fulcrum based tools, intended for hand use, typically include a handle and a head held in a fixed ratio with a pivot.

Maintaining the fixed ratio between the handle and the head enables force multiplication; however, controlling the tool relies almost entirely on the skill of the operator and when utilized by people of differing physical size and strength, this is not always easy or even possible. This problem can be seen when a work piece is so large that in order to fit it within the head, the handles must be spread apart to an angle that does not allow for easy gripping even with large hands. The same problem can be seen when the work to be accomplished requires extreme forces and even with the mechanical advantage of the fixed ratio, a person may simply not be able to squeeze hard enough, and in the event that they struggle to apply the requisite force, the result will nearly always be completely uncontrollable. Many attempts to resolve this problem have not resulted in a complete or meaningful solution.

One attempt to resolve this problem is to increase the fulcrum length providing more mechanical advantage to the head. This results in a larger tool that can be even more unwieldy and thereby cause physical damage to a work piece. In the event the increased fulcrum length provides enough mechanical advantage new problems arise due to the length of travel required by the larger handles. The larger travel can necessitate the use of two hands eliminating the ability to handle or control the work piece.

Another attempt to resolve this problem is to provide a moveable pivot. These tools are known as tongue and groove pliers and allow the handles to be operated within a comfortable range of motion even with larger work pieces. Improvements to the tongue and groove pliers have included a self-selecting pivot based on the size of the work piece and eliminate the clumsiness of choosing a pivot point setting before beginning work, and while the moveable pivot does make the tool easier to control in one aspect, the moveable pivot fails to solve the problem arising from inadequate mechanical advantage.

Other attempts focus on including ratchets, locks, ergonomic handles and other partial solutions, but have limited applicability and still fail to provide intuitive control, increased mechanical advantage, while allowing for a natural range of motion. All previous attempts have failed to provide a complete solution, but have instead addressed only the ergonomic manifestation of the problem or the mechanical advantage manifestation of the problem but not both. Solutions have been long sought but prior developments have not taught or suggested any solutions, and thus, solutions to these problems have long eluded those skilled in the art.

SUMMARY OF THE INVENTION

The claimed invention is directed to mechanism systems that can utilize a load responsive component to engage a mechanism and thereby implement a first ratio of movement and a second ratio of movement. Among the many different possibilities contemplated, a collapsible lever can be utilized as a platform for the load responsive component and the mechanism.

It is further contemplated that the load responsive component may deform in the presence of a load. It is further contemplated that a fulcrum in various configurations can be implemented within the mechanism.

It is further contemplated that the mechanism can be a large gear and small gear, a cable and selector, or a combination thereof. It is further contemplated that the mechanism can include a torsion lock.

It is further contemplated that the mechanism can include an engagement lever. It is further contemplated that the mechanism can include a large gear and a small gear fixed with respect to each other.

The present invention further includes objects, features, aspects, and advantages in addition to or in place of those mentioned above. These objects, features, aspects, and advantages of the present invention will become more apparent from the following detailed description of preferred embodiments of the invention, along with the accompanying drawings.

BRIEF DESCRIPTION OF THE DRAWINGS

The invention is illustrated in the figures of the accompanying drawings which are meant to be exemplary and not limiting, in which like reference numerals are intended to refer to like components, and in which.

DETAILED DESCRIPTION OF THE PREFERRED EMBODIMENTS

Figure 1:
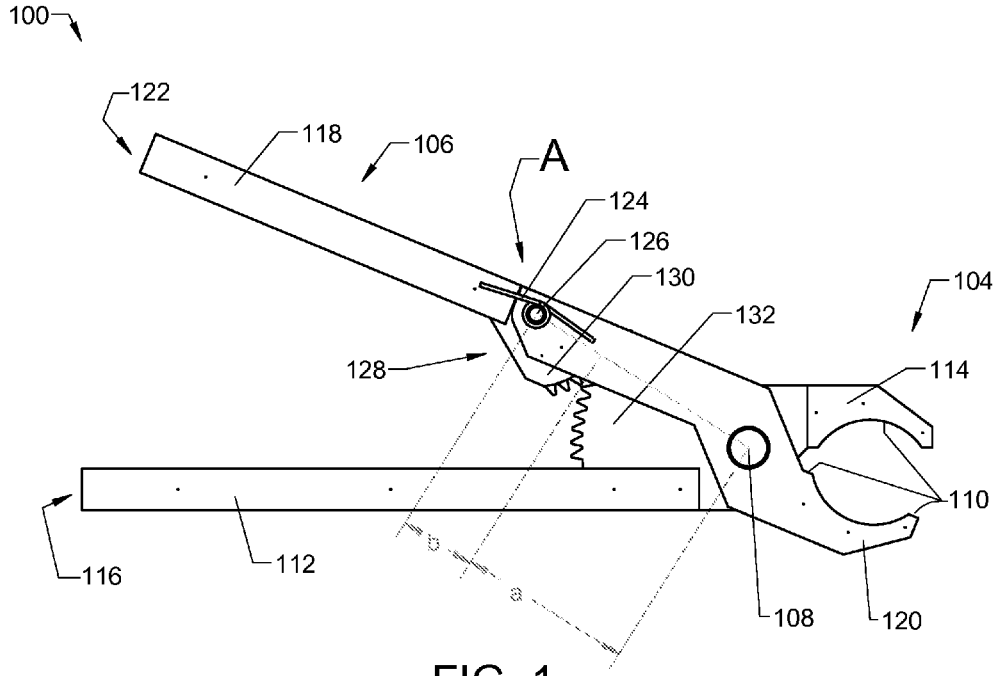
FIG. 1 is a side view of a geared pair of pliers in a first embodiment of the present invention not under load.

In the following description of the preferred embodiments, reference is made to the accompanying drawings that form a part hereof, and in which are shown by way of illustration, preferred embodiments in which the invention may be practiced. It is to be understood that other embodiments may be utilized and structural changes may be made without departing from the scope of the present invention.

The following preferred embodiments disclose a mechanism system implemented within various sets of pliers for clarity and descriptive convenience. The mechanism system is described in sufficient detail to enable those skilled in the art to make and use the invention and provide numerous specific details to give a thorough understanding of the invention; however, it will be apparent that the invention may be practiced without these specific details.

In order to avoid obscuring the present invention, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGS. Generally, the invention can be operated in any orientation.

The preferred embodiments have been numbered first embodiment, second embodiment, etc. as a matter of descriptive convenience and are not intended to have any other significance or provide limitations for the present invention.

For expository purposes, the term "horizontal" as used herein is defined as a plane parallel to the top plane or surface of the lower lever, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane.

As used herein, the term "ratio" is defined as the quotient of two features. The term "work surface" is defined as a portion of a system intended to exert force on or output force to an object external to the system. The term "load" is defined as a force or forces applied to the work surface. The term "elastic component" is defined as an element which returns to its original shape after being deformed under a load. The term "mechanism" is defined as a component or components that provide mechanical advantage and transform input forces and movement into a desired set of output forces and movement. The term "lever" is defined as a member that pivots on a fulcrum. The term "couple", as in coupling or coupled, is defined as a physical connection.

Referring now to FIG. 1, therein is shown a side view of a geared pair of pliers 100 in a first embodiment of the present invention not under load. The pair of pliers 100 can be a system depicted to include jaws 104 in direct mechanical linkage with handles 106 pivoting on a fulcrum or a pivot point 108.

The jaws 104 include work surfaces 110. It is contemplated that the work surface 110 can be a ridged surface or a deformable surface and can be smooth, grooved, or edged. The jaws 104 are contemplated to grasp, manipulate, or cut a work piece (not shown) external to the pair of pliers 100.

The pivot point 108 is depicted between the jaws 104 and the handles 106. The pivot point 108 can be used to apply mechanical advantage between the handles 106 and the jaws 104 depending on where force is applied along the handles 106 and the jaws 104. When force is applied along the handles 106 at a different distance from the pivot point 108 than a load applied along the jaws 104, mechanical advantage will be present. As is the case with lever systems, the mechanical advantage induced by the pivot point 108 will follow the equation: Mechanical Advantage of the pivot point 108 equals the distance of a force on the handles 106 from the pivot point 108 divided by the distance of a force on the jaws 104 from the pivot point 108.

The handles 106 and the jaws 104 can form two levers that pivot about the pivot point 108. A lower handle 112 coupled to an upper jaw 114 and configured to pivot about the pivot point 108 can comprise a lower lever 116. An upper handle 118 coupled to a lower jaw 120 can comprise a collapsible upper lever 122. The upper lever 122 and the lower lever 116 are shown to be directly coupled by the pivot point 108, can both pivot about the pivot point 108 and can be used to apply mechanical advantage to a work piece manipulated with the jaws 104.

When no load is present on the work surface 110 the upper lever 122 and the lower lever 116 move in a fixed angular speed with the lower handle 112 and the upper handle 118, respectively. That is to say that when the upper handle 118 and the lower handle 112 are moved from zero degrees apart to forty five degrees apart, the upper jaw 114 and the lower jaw 120 will move at the same angular velocity from zero degrees apart to forty five degrees apart.

When the upper handle 118 and the lower handle 112 move with the same angular speed as the lower jaw 120 and the upper jaw 114, respectively, this ratio of movement can be referred to as a first ratio of movement. The first ratio of movement is seen when there is no load present on the work surface 110. The ratio of movement is the quotient of the angular motion of the handles 106 and the angular movement of the jaws 104.

It is contemplated that the first ratio of movement can include other ratios of movement not necessarily about a fulcrum. For instance it is contemplated that the first ratio of movement in a different embodiment may be the angular movement of a lever in relation to the vertical movement of a work surface. This may be the case in a car jack or like application. While the first ratio of movement is not necessarily indicative of one to one angular movement, the first ratio of movement is indicative of little or no load on the work surface 110.

The first ratio of movement will be seen when a load on the work surface 110 falls below a threshold. This can be no load but it can also include a load higher than zero but still below a pre-determined threshold of force.

The threshold of force is determined by a load responsive component 124. The load responsive component 124 can be located on the upper lever 122, the lower lever 116, or both; but, in the present embodiment the load responsive component 124 is depicted as integrated into the upper lever 122.

The load responsive component 124 can be an elastic component including springs, rubber bands, or other suitable elastic structure. The load responsive component 124 can also include inelastic component including a glass or plastic rod that fractures above a load threshold. Finally, it is contemplated that the load responsive component 124 can be an active component like a DC motor coupled to a battery and configured to move when a load is present on the jaws 104.

The load responsive component 124 is integrated into the upper lever 122. The upper lever 122 can be a collapsible lever. Collapsible lever is defined as a lever that is not rigid along its entire length. In the present embodiment, the upper lever 122 is a collapsible lever because it includes a lever fulcrum 126.

The lever fulcrum 126 allows the upper lever 122 to move in a non-rigid manner. It is contemplated that the lever fulcrum 126 can be replaced with the load responsive component 124 only or work in conjunction with the load responsive component 124.

In the present embodiment, the load responsive component 124 can be coupled to the upper lever 122 with two separate ends and attach to the upper lever 122 on different sides of the lever fulcrum 126. Attachment in this manner allows the upper lever 122 to collapse about the lever fulcrum 126 when a load is present on the work surface 110 of the jaws 104 and return to an uncollapsed state when the load on the work surface 110 of the jaws 104 is not present. The lower jaw 120 is depicted being fixed with respect to the fulcrum 126 while the upper jaw 114 is depicted being fixed with respect to the lower handle 112.

The load responsive component 124 has a strength that resists movement. When a load is placed on the work surface 110 of the jaws 104, the load responsive component 124 will resist movement based on the strength of the load responsive component 124. When the load on the work surface 110 is greater than the strength of the load responsive component 124 the load responsive component 124 will move relative to the upper lever 122 and allow the upper lever 122 to collapse.

The strength of the load responsive component 124 determines the threshold of load on the work surface 110 that is required to collapse the upper lever 122. When the upper lever 122 collapses, a mechanism 128 engages to increase the mechanical advantage between the handles 106 and the jaws 104.

The mechanism 128 can include two states, an engaged state and a non-engaged state. Once the mechanism 128 is in the engaged state the ratio of movement between the jaws 104 and the handles 106 change. This ratio of movement can be understood as a second ratio of movement. The second ratio of movement can be less than or more than the first ratio of movement depending on the mechanism 128.

The mechanism 128 increases or decreases the mechanical advantage on the jaws 104 by the multiplying the force by a "distance a" divided by a "distance b": (da)/(db) times the mechanical advantage gained from the upper lever 122 and the lower lever 116. When da is greater than db, the mechanical advantage will be less when the mechanism 128 is engaged but the second ratio of movement will be larger than the first ratio of movement. On the other hand, when da is less than db, the mechanical advantage will be more when the mechanism 128 is engaged and the second ratio of movement will be less than the first ratio of movement.

The mechanism 128 can include any suitable mechanical advantage system such as pulleys, gears, levers, or similar mechanisms. In the present embodiment, the mechanism 128 includes a small gear 130 firmly affixed to the collapsible lever 122 with rotational center around lever fulcrum 126 and a large gear 132 firmly affixed to the lower handle 112 with rotational center around pivot point 108. When the upper lever 122 collapses about the lever fulcrum 126 and the mechanism 128 engages the small gear 130 meshes with the large gear 132 enabling the second ratio of movement to multiply the mechanical advantage to the jaws 104.

The small gear 130 can be rigidly coupled to the upper lever 122 while the large gear 132 can be rigidly coupled to the lower lever 116. The mechanism 128 can be configured to engage when the load responsive component 124 moves relative to the upper lever 122, the upper lever 122 collapses in the presence of a load on the work surface 110 above a threshold, or a combination thereof.

Figure 2:
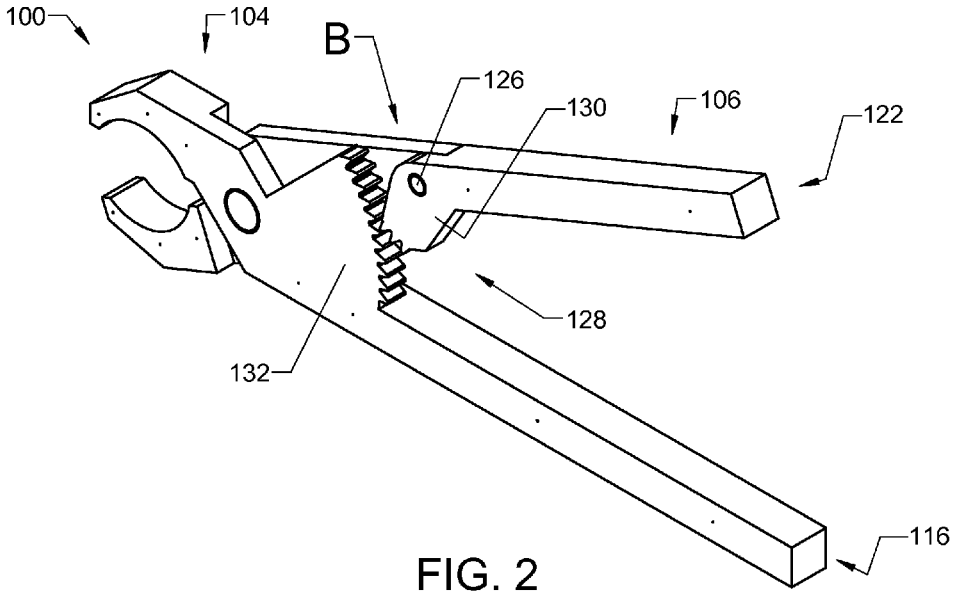
FIG. 2 is an isometric view of the pair of pliers of FIG. 1.

Referring now to FIG. 2, therein is shown an isometric view of the pair of pliers 100 of FIG. 1. The pair of pliers 100 is shown having the upper lever 122 including the lever fulcrum 126 allowing the upper lever 122 to collapse. The upper lever 122 is further depicted including the small gear 130.

The upper lever 122 is shown in an uncollapsed state with the upper lever 122 straight and no load present on the jaws 104. The small gear 130 is depicted extended away from the lever fulcrum 126 toward the lower lever 116 with the small gear 130 and the large gear 132 having a space therebetween. The large gear 132 is shown integrally formed with the lower lever 116 and positioned to mesh with the small gear 130 when the load responsive component 124 (of FIG. 1) moves and the upper lever 122 collapses.

As the lower lever 116 and the upper lever 122 move relative to each other, the small gear 130 will also change position relative to the large gear 132. When the mechanism 128 is engaged, the small gear 130 will mesh with the large gear 132 by pivoting on the lever fulcrum 126 angling the small gear 130 toward the large gear 132 and enmeshing with the large gear 132 at any point along the large gear 132 closest to the position of the small gear 130.

Figure 3:
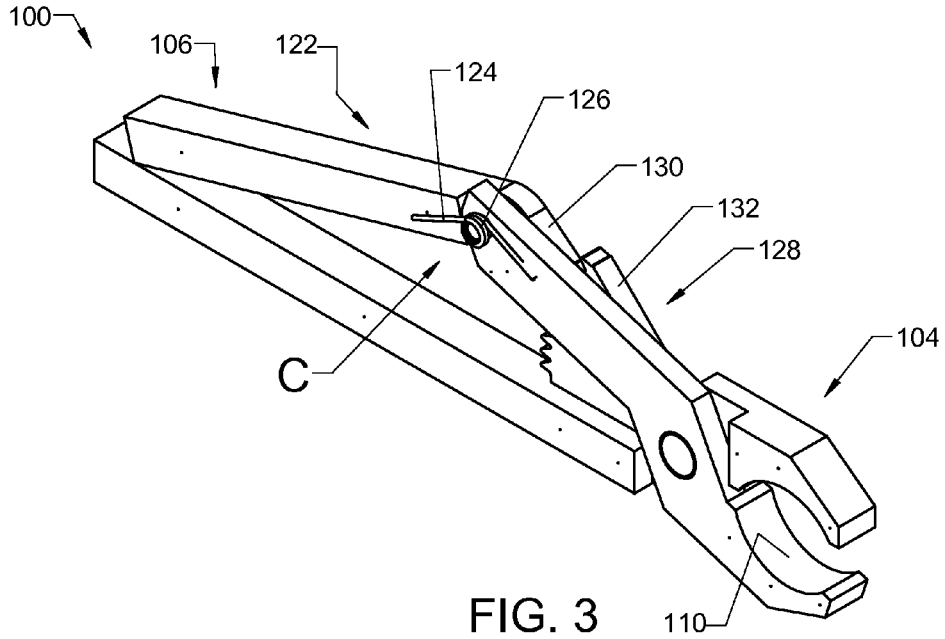
FIG. 3 is an isometric view of the pair of pliers of FIG. 1 under load.

Referring now to FIG. 3, therein is shown an isometric view of the pair of pliers 100 of FIG. 1 under load. The upper lever 122 is depicted as collapsed about the lever fulcrum 126. The load responsive component 124 is moved and deformed under load allowing the small gear 130 to mesh with the large gear 132. In this embodiment, the load responsive component 124 is an elastic component such as a spring and when a user releases the handles 106 the load responsive component 124 will return the upper lever 122 to an uncollapsed state.

The work surfaces 110 of the jaws 104, in this configuration of the first embodiment, will have a load (not shown) large enough to overcome the strength of the load responsive component 124. Once the load begins to increase to the point where the load responsive component 124 can no longer keep the upper lever 122 straight, the upper lever 122 will collapse as is depicted. When the load responsive component 124 begins to move or deform, the mechanism 128 will engage and the ratio of movement between the handles 106 and the jaws 104 will switch from the first ratio of movement to the second ratio of movement.

It has been discovered that the upper lever 122 coupled to the load responsive component 124 and allowed to collapse under load to engage the mechanism 128, provides great improvements in the controllability of the pair of pliers 100. As soon as a load on the work surface 110 overcomes the load responsive component 124 the second ratio of movement will engage. This provides a smaller range of motion requirement, an increased mechanical advantage, and a slower ratio of movement. These benefits markedly improve the controllability of the pair of pliers 100 over the prior art and solve the problems described above which plagued previous designs.

It has been discovered that coupling the load responsive component 124 with the upper lever 122 and configured to engage the mechanism 128 when the upper lever 122 collapses under load allows users to manipulate objects using less force helping to eliminate discomfort caused by prior designs. The load responsive component 124 engaging the mechanism 128 under load also allows the jaws 104 to move in the first ratio of movement before the load is applied and the second ratio of movement after the load is applied. This multiple ratio of movement allows a user to quickly engage a load and thereafter carefully manipulate the load with one simple squeeze of the handles 106.

Figure 4:
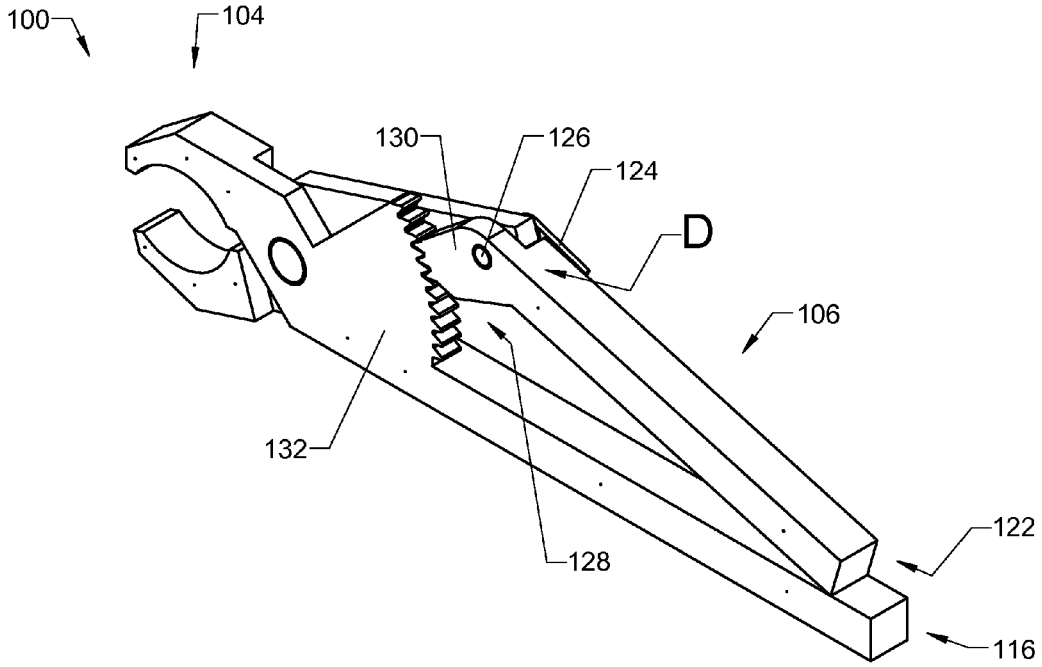
FIG. 4 is an isometric view of the pair of pliers of FIG. 1 under load.

Referring now to FIG. 4, therein is shown an isometric view of the pair of pliers 100 of FIG. 1 under load. The pair of pliers 100 is depicted with the small gear 130 meshed with the large gear 132 and with the small gear 130 in line with and between the pivot point 108 and the lever fulcrum 126. The small gear 130 is shown pivoted about the lever fulcrum 126 toward the large gear 132.

The large gear 132 is shown integrally formed with the lower lever 116 while the small gear 130 is shown integrally formed with the upper lever 122. When the load responsive component 124 moves or deforms and the upper lever 122 collapses engaging the mechanism 128, the jaws can continue to move closer together with an increased force multiplier applied to a work piece.

After the mechanism 128 is engaged, the second ratio of movement is applied between the handles 106 and the jaws 104 limiting the range of motion available to the jaws 104. As can be seen, when the mechanism 128 is engaged while the jaws 104 are far apart, the handles 106 can continue to be closed until they touch while the jaws 104 move only a fraction of the amount they would have moved if the mechanism 128 was not engaged.

It has been discovered that coupling the load responsive component 124 to the mechanism 128 enabling a first and second ratio of movement greatly increases the precision available to a user by limiting the range of motion available to the jaws 104 while the mechanism 128 is engaged. The dual ratio of movement available allows a user to quickly engage a work piece under the first ratio of movement, and seamlessly transition to apply a great force without the jaws 104 moving a large distance after the mechanism 128 is engaged and under the second ratio of movement.

Figure 5:
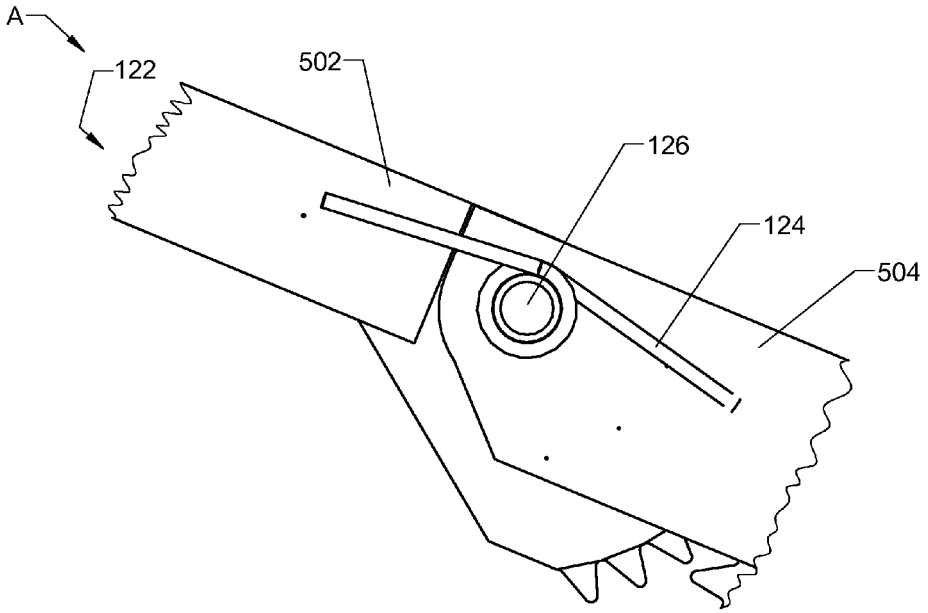
FIG. 5 is a detailed view of region A of FIG. 1.

Referring now to FIG. 5, therein is shown a detailed view of region A of FIG. 1. The load responsive component 124 is depicted as supporting the upper lever 122 in a straight or uncollapsed position.

The load responsive component 124 can be coupled on two ends to the upper lever 122 and coupled to the lever fulcrum 126. The upper lever 122 can include a proximal end 502 and a distal end 504 relative to the handles 106 of FIG. 1. The proximal end 502 is closer to the handles 106 while the distal end 504 is closer to the jaws 104 of FIG. 1.

The proximal end 502 and distal end 504 can hinge or pivot at the lever fulcrum 126. The proximal end 502 and the distal end 504 can be configured so as to have equal or less than 180 degrees of movement. When the distal end 504 and the proximal end 502 are in line, making the upper lever 122 straight, the proximal end 502 will not move any further away from the lower lever 116 of FIG. 1 but is limited by design to a straight line uncollapsed position. A surface on the distal end 504, connected to the lower jaw, is configured for engagement with respective first and second surfaces on the proximal end 502, connected to the upper handle, to limit a maximum and a minimum pivot positions of the upper handle about the lever fulcrum 126 relative to the lower jaw, defining the uncollapsed and collapsed states.

Figure 6:
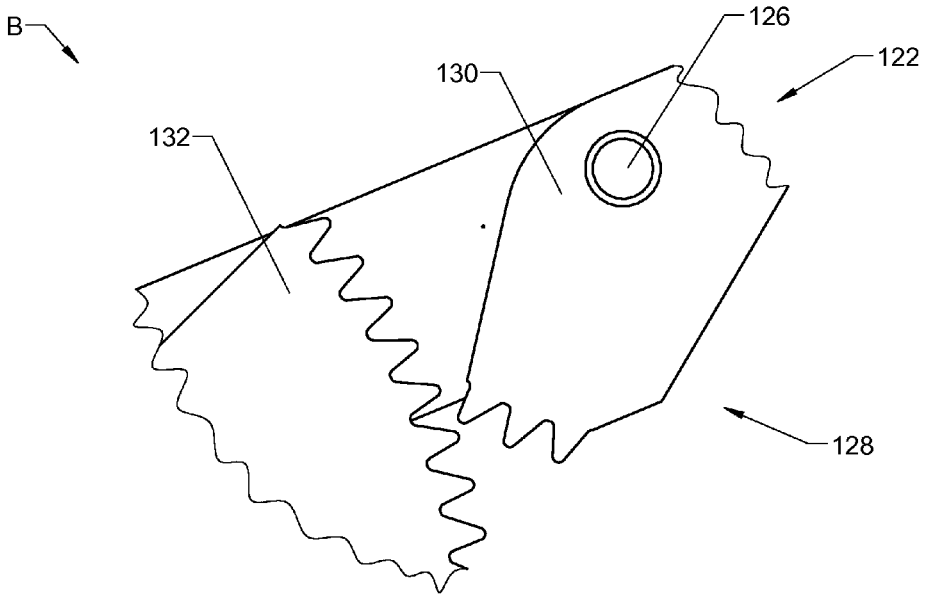
FIG. 6 is a detailed view of region B of FIG. 2.

Referring now to FIG. 6, therein is shown a detailed view of region B of FIG. 2. The mechanism 128 is depicted with the small gear 130 and the large gear 132 having sufficient distance therebetween to allow free movement of the small gear 130 relative to the large gear 132.

The distance between the small gear 130 and the large gear 132 should be enough to allow free movement when the upper lever 122 is uncollapsed. The small gear 130 and the large gear 132 should be close enough so that when the upper lever 122 collapses and the small gear 130 pivots about the lever fulcrum 126 toward the large gear 132, the large gear 132 and the small gear 130 will enmesh engaging the mechanism 128.

Figure 7:
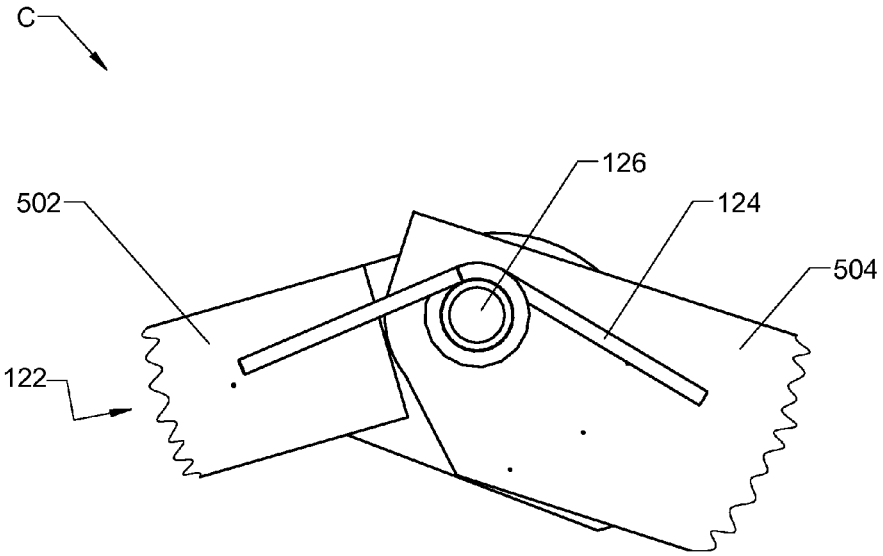
FIG. 7 is a detailed view of region C of FIG. 3.

Referring now to FIG. 7, therein is shown a detailed view of region C of FIG. 3. The upper lever 122 is shown collapsed about the lever fulcrum 126 with the load responsive component 124 deformed or moved.

Figure 8:
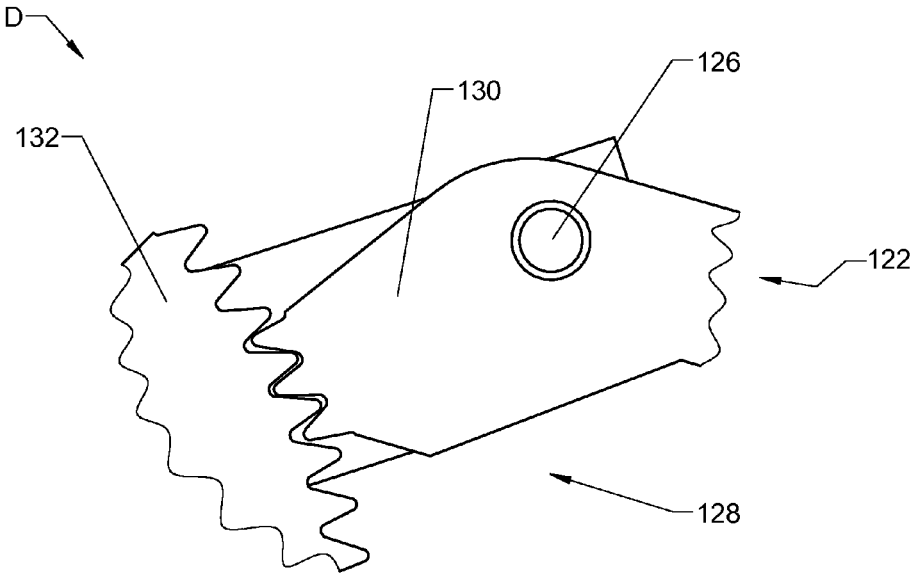
FIG. 8 is a detailed view of region D of FIG. 4.

Referring now to FIG. 8, therein is shown a detailed view of region D of FIG. 4. The mechanism 128 of the upper lever 122 is shown engaged with the small gear 130 enmeshed with the large gear 132. The small gear 130 is shown pivoted about the lever fulcrum 126 towards the large gear 132 decreasing the distance therebetween until the small gear 130 is meshed with the large gear 132.

Figure 9:
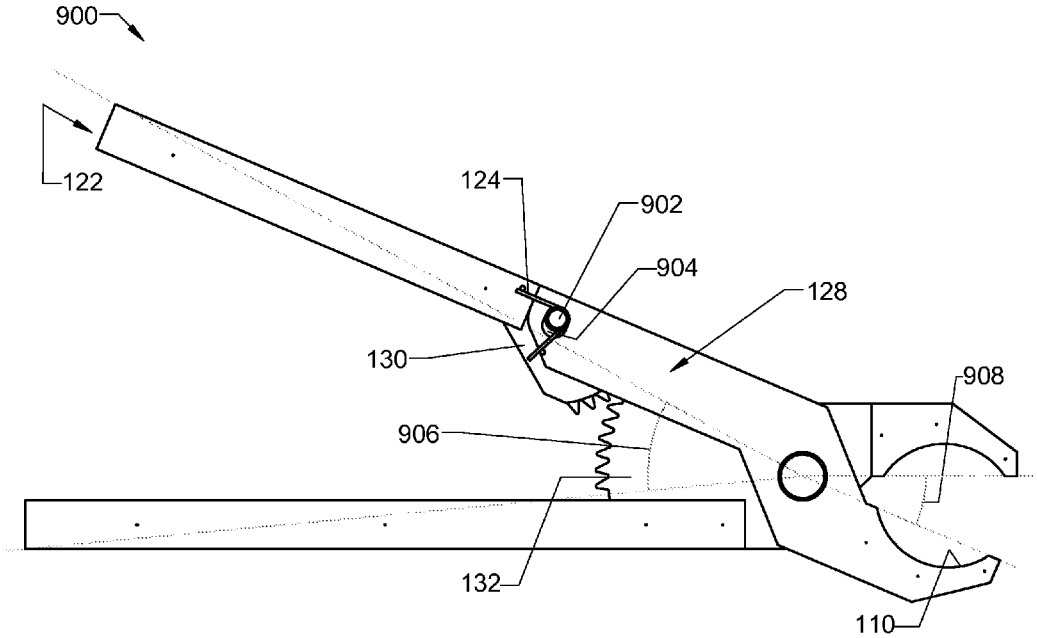
FIG. 9 is a side view of a geared pair of pliers with a slot fulcrum in a second embodiment of the present invention not under load.

Referring now to FIG. 9, therein is shown a side view of a geared pair of pliers 900 with a slot fulcrum in a second embodiment of the present invention not under load. The pair of pliers 900 in the second embodiment is similar to the pair of pliers 100 of the first embodiment of FIG. 1.

The pair of pliers 900 is depicted having a slot fulcrum 902 rather than the lever fulcrum 126 of FIG. 1. The slot fulcrum 902 allows the small gear 130 a small amount of slack or slippage when pivoting toward the large gear 132.

When the upper lever 122 is straight the slot fulcrum 902 is in an upper position within a slot 904. The slot fulcrum 902 is held into position by the load responsive component 124.

When a load is applied to the work surface 110, the load responsive component 124 will deform and the upper lever 122 will collapse and the slot fulcrum 902 will pivot within the slot 904 and will simultaneously move down in the slot 904. Because the load responsive component 124 is depicted as an elastic spring, when the load is released, the slot fulcrum 902 will move back up within the slot 904 and the upper lever 122 will return to a straight uncollapsed state.

It has been discovered that utilizing the slot fulcrum 902 in combination with the mechanism 128 provides a better engagement of the mechanism 128 under load. The slot fulcrum 902 allows the small gear 130 to move a minute amount in order to engage the large gear 132 more efficiently. The pair of pliers 900 is depicted under a first ratio of movement where any change in handle angle 906 corresponds in a 1:1 corresponding change in a jaw angle 908.

Figure 10:
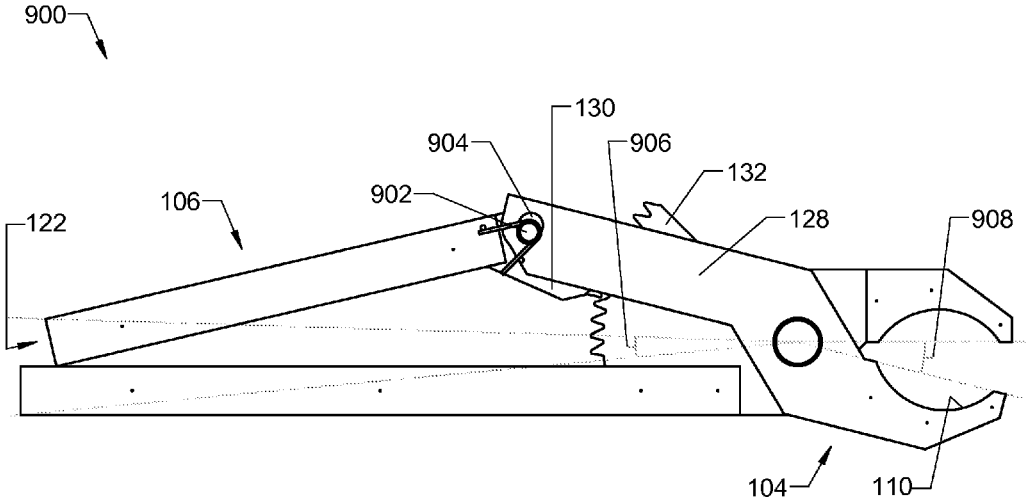
FIG. 10 is a side view of the pair of pliers of FIG. 9 under load.

Referring now to FIG. 10, therein is shown a side view of the pair of pliers 900 of FIG. 9 under load. The slot fulcrum 902 is shown in a lower position of the slot 904.

The small gear 130 has pivoted about the slot fulcrum 902 and has engaged the large gear 132 as the upper lever 122 collapsed in the presence of a load on the work surface 110 of the jaws 104.

The handle 106 to jaw 104 ratio of movement has transitioned from the first ratio of movement when the mechanism 128 is not engaged to the second ratio of movement as the mechanism 128 engages. As can be seen the change in the handle angle 906 is much greater than the change in the jaw angle 908.

It is contemplated that the slot 904 can allow for elliptical gears to be used as the small gear 130. Elliptical gearing would enable the mechanism 128 to have one mechanical advantage multiplier at the beginning of the engagement of the mechanism 128 and a different mechanical advantage multiplier as the handles 106 continue to be depressed.

Figure 11:
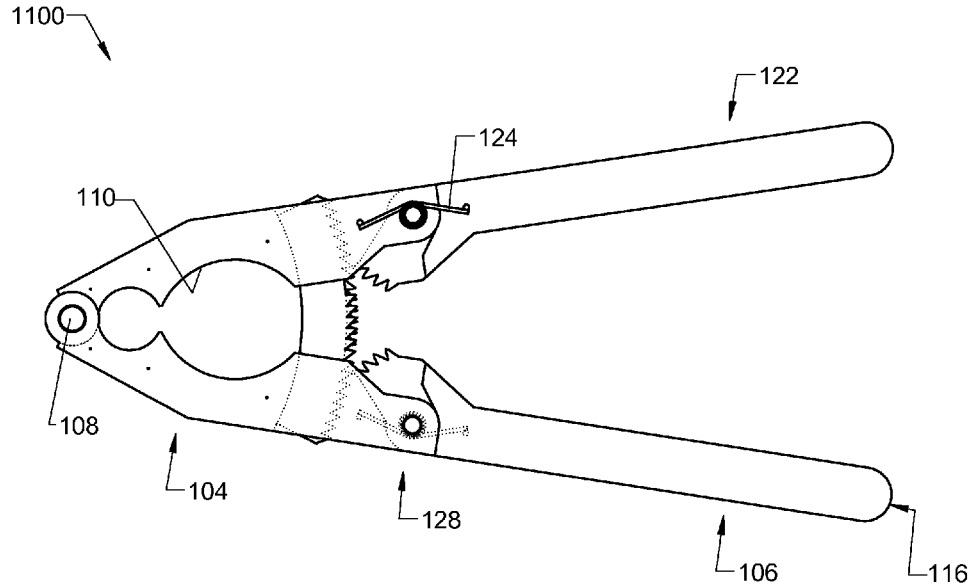
FIG. 11 is a side view of a geared nutcracker pair of pliers in a third embodiment of the present invention not under load.

Referring now to FIG. 11, therein is shown a side view of a geared nutcracker pair of pliers 1100 in a third embodiment of the present invention not under load. The pair of pliers 1100 can be depicted in a similar manner to the pair of pliers 100 of FIG. 1.

The pair of pliers 1100 can be depicted having the upper lever 122 and the lower lever 116 including the jaws 104 and the handles 106. The pair of pliers 1100 differs from the pair of pliers 100 in one respect by including the pivot point 108 on a far end of the jaws 104 rather than between the jaws 104 and the handles 106.

The pair of pliers 1100 differs from the pair of pliers 100 in another respect by including multiple instances of the mechanism 128 on the upper lever 122 and the lower lever 116. This allows both the upper lever 122 and the lower lever 116 to collapse under a load on the work surface 110 of the jaws 104.

When both the upper lever 122 and the lower lever 116 collapse and engage the mechanisms 128 on both levers, the mechanical advantage of the pivot point 108 is multiplied by the mechanical advantage supplied by the mechanisms 128 on both the upper lever 122 and the lower lever 116. It is contemplated that the load responsive component 124 on the upper lever 122 can be set to deform under different load thresholds than the load responsive component 124 on the lower lever 116.

Different load thresholds of the load responsive components 124 will result in an offset engagement of the two mechanisms 128 would act to apply much greater mechanical advantage as loads increased but in defined increments. Including the mechanism 128 on both the upper lever 122 and the lower lever 116 would allow much larger work pieces to be handled comfortably by a user.

Figure 12:
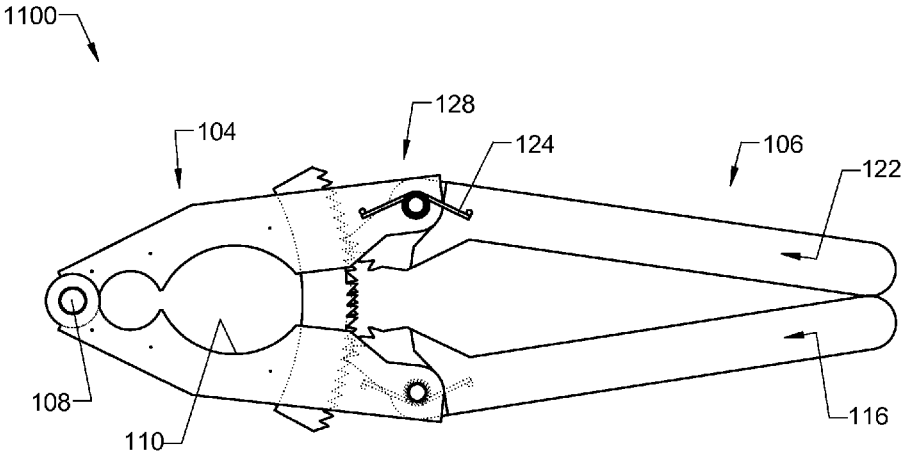
FIG. 12 is a side view of the pair of pliers of FIG. 11 under load.

Referring now to FIG. 12, therein is shown a side view of the pair of pliers 1100 of FIG. 11 under load. The mechanisms 128 on the upper lever 122 and the lower lever 116 are both depicted as engaged under a load on the work surface 110 of the jaws 104.

Due to the upper lever 122 and the lower lever 116 both having the mechanism 128, the range of motion of the jaws 104 is more limited once the load responsive component 124 deform and engage the mechanism 128. When neither of the mechanisms 128 are engaged, the jaws 104 and the handles 106 will move in the first ratio of movement.

When the mechanism 128 of the lower lever 116 or the mechanism 128 of the upper lever 122 is engaged, the jaws 104 and the handles 106 will move in the second ratio of movement. When the both mechanisms 128 are engaged the jaws 104 and the handles 106 will move in a third ratio of movement Referring now to FIG. 13, therein is shown a side view of a geared pair of pliers 1300 with a torsion lock in a fourth embodiment of the present invention not under load. The pair of pliers 1300 is similar to the pair of pliers 100 of FIG. 1.

The pair of pliers 1300 is depicted having the jaws 104 and the handles 106 hinging or pivoting about the pivot point 108. The work surface 110 of the jaws 104 is depicted as flat with grooves for additional grip during operation. The load responsive component 124 can be internal to the upper lever 122.

The upper lever 122 is depicted as collapsible having the lever fulcrum 126 set to engage the mechanism 128 when the upper lever 122 collapses. The mechanism 128 is shown having much finer teeth and having a smaller distance between the small gear 130 and the large gear 132.

Additionally the upper lever 122 is shown having a handle lock 1302. The handle lock 1302 can be any suitable means of stopping the upper lever 122 from collapsing and engaging the mechanism 128. The present embodiment depicts the handle lock 1302 as a peg that can be slid through the small gear 130 fixing the small gear 130 by two points, the lever fulcrum 126 and the handle lock 1302.

When the small gear 130 is locked into place, the mechanism 128 will not engage and the upper lever 122 will not collapse under a load placed on the work surface 110. It is also contemplated that the handle lock 1302 might wrap around the upper lever 122, form a friction lock within the upper lever 122, include active battery operated components, or other suitable methods of prohibiting the upper lever 122 from collapsing.

Further, the present embodiment includes a torsion lock 1304 within the mechanism 128. The torsion lock 1304 includes a plate 1306, a groove 1308, and a spring 1310.

The plate 1306 can be seen around the large gear 132 having one end within the groove 1308 formed into the small gear 130. The spring 1310 is affixed to the plate 1306 and when the upper lever 122 is not collapsed, keeps the torsion lock 1304 from locking and prohibiting movement of the upper lever 122 and the lower lever 116.

The torsion lock 1304 will slide along the large gear 132 when the upper lever 122 is not collapsed and remain in a fixed position relative to the small gear 130 of the mechanism 128. When the upper lever 122 begins to collapse and the small gear 130 begins to pivot about the lever fulcrum 126, the plate 1306 will be angled by the groove 1308 in the small gear 130 and compress the spring 1310.

When the plate 1306 is angled about the large gear 132 it will act as a lock preventing movement of the handles 106. The lock is easily maintained with only a very small force required to compress the spring 1310.

Figure 13:
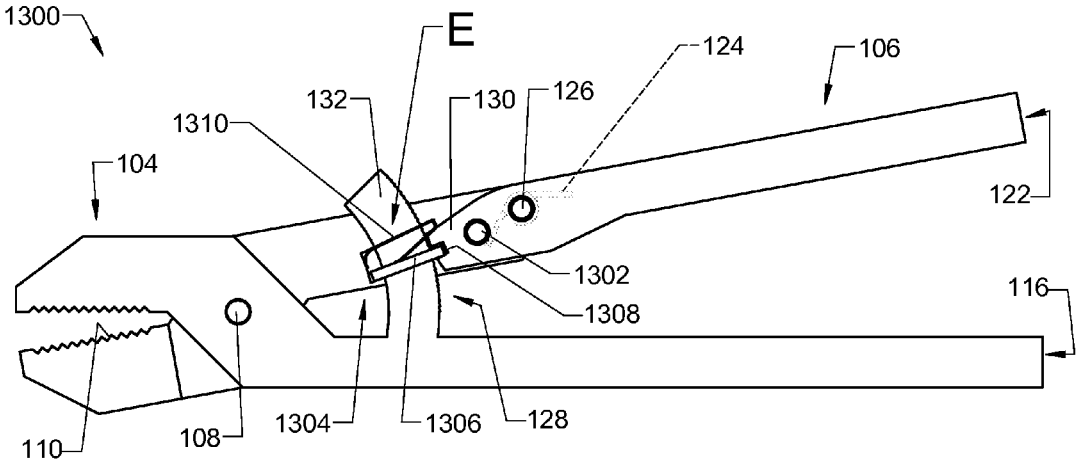
FIG. 13 is a side view of a geared pair of pliers with a torsion lock in a fourth embodiment of the present invention not under load.
Figure 14:
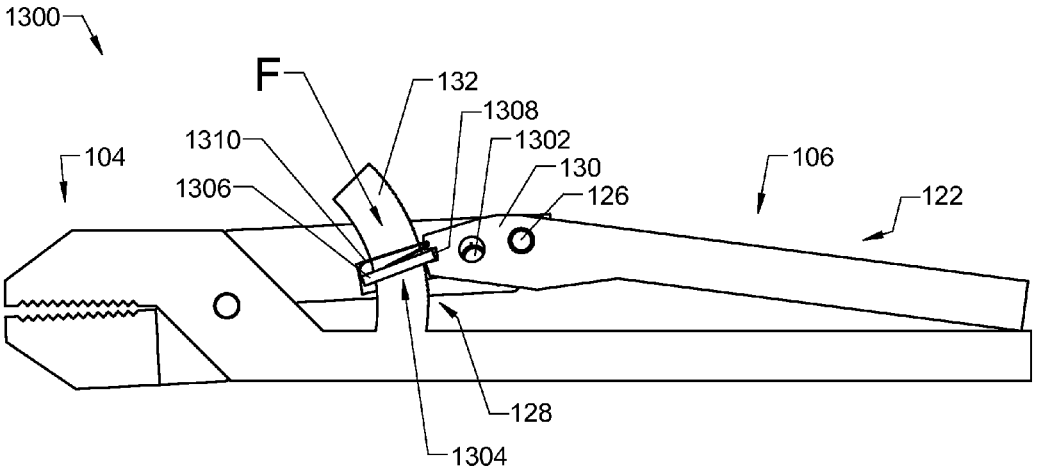
FIG. 14 is a side view of the pair of pliers of FIG. 13 under load.

Referring now to FIG. 14, therein is shown a side view of the pair of pliers 1300 of FIG. 13 under load. The upper lever 122 is depicted as collapsed with the mechanism 128 engaged.

The handle lock 1302 is not engaged and can be seen not impeding movement of the small gear 130 as the mechanism 128 engages. The torsion lock 1304 is also shown, engaging with the large gear 132, locking the jaws 104 and the handles 106 into a lowered position.

The spring 1310 is depicted as compressed while the plate 1306 is angled about the large gear 132. The plate 1306, riding in the groove 1308, is angled up by the groove 1308 when the small gear 130 begins to angle toward the large gear 132 and when the small gear 130 meshes with the large gear 132.

It has been discovered that providing the torsion lock 1304 configured to utilize the small gear 130 and the large gear 132 of the mechanism 128 provides a simple and effective solution allowing users to have very delicate control of the pair of pliers 1300. This control is achieved by engaging the torsion lock 1304 once the jaws 104 have engaged a load under the second ratio of movement.

It has further been discovered that the spring 1310 can be configured to allow the torsion lock 1304 to engage at a specific threshold, thus allowing for only a specific amount of force to be placed on a work piece. Providing this ability, allows even inexperienced users fast and accurate manipulation of work pieces.

Figure 15:
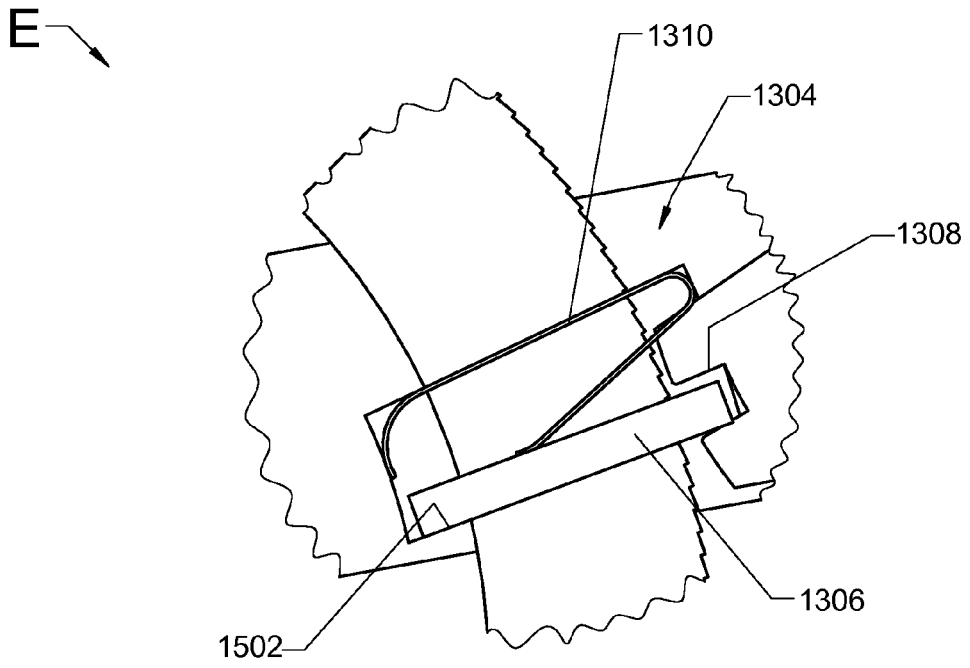
FIG. 15 is a detailed view of region E of FIG. 13.

Referring now to FIG. 15, therein is shown a detailed view of region E of FIG. 13. The detailed view depicts the torsion lock 1304 in greater detail.

The plate 1306 can be seen within the groove 1308 on the small gear 130. The opposite side of the plate 1306 from the groove 1308, the plate 1306 rests on a ledge 1502. The plate 1306 is resting within the groove 1308 and upon the ledge 1502 while being held in place by the spring 1310.

Figure 16:
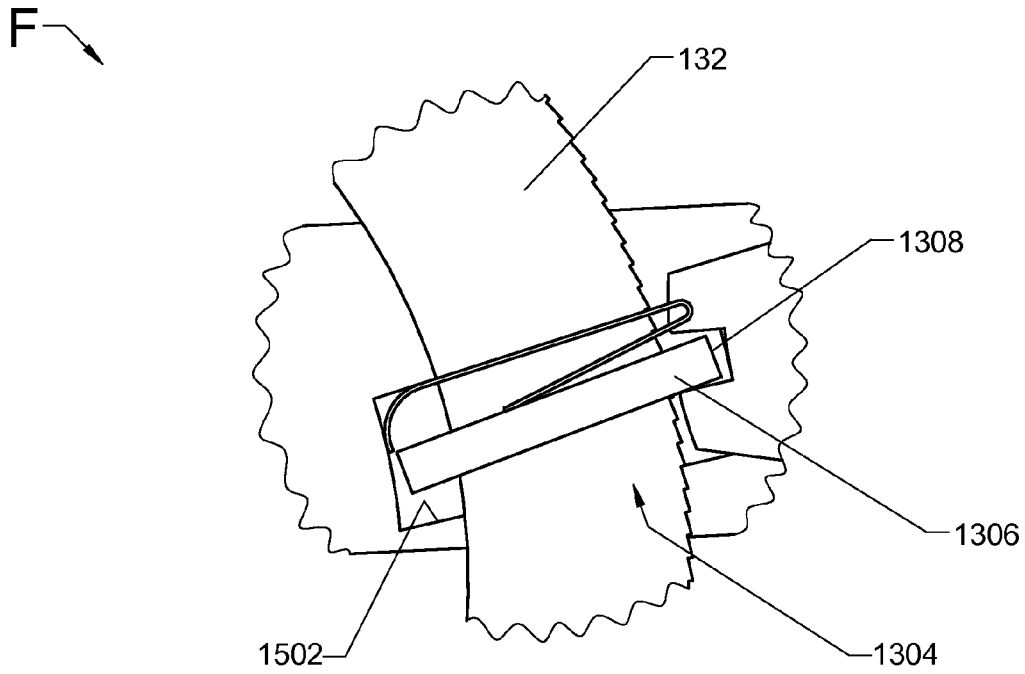
FIG. 16 is a detailed view of region F of FIG. 14.

Referring now to FIG. 16, therein is shown a detailed view of region F of FIG. 14. The torsion lock 1304 is depicted in greater detail.

The plate 1306 can now be seen skewed up toward the groove 1308 and still resting on the ledge 1502. The torsion lock 1304 will engage the large gear 132 in this position and prohibit movement of the jaws 104 and handles 106 of FIG. 14.

Figure 17:
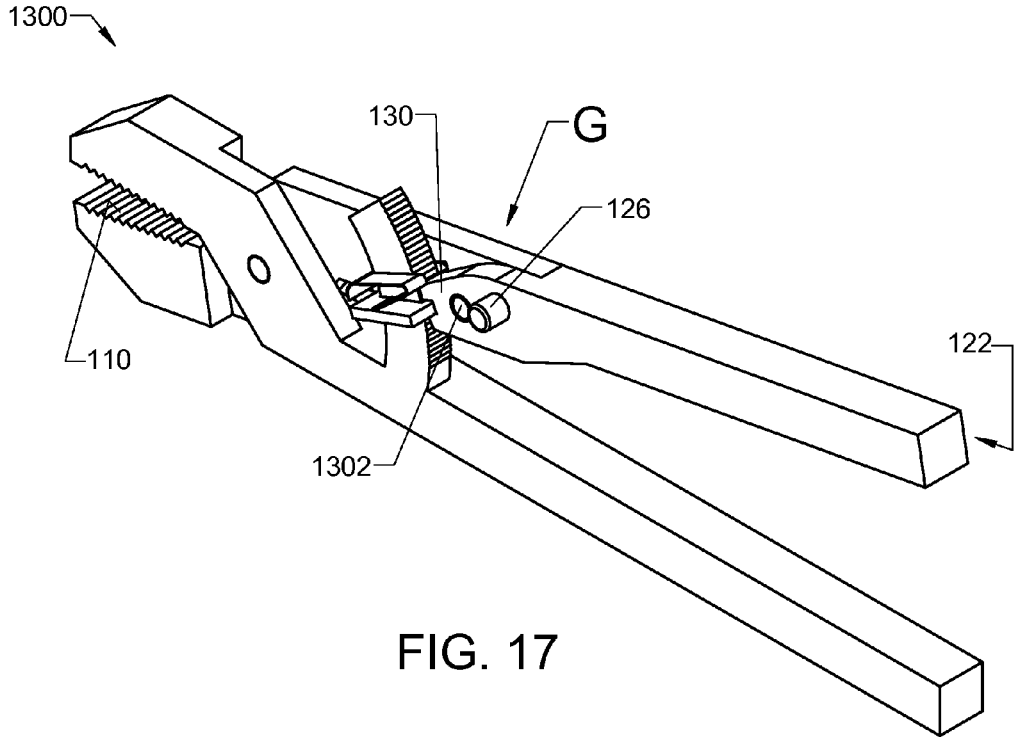
FIG. 17 is an isometric view of the pair of pliers of FIG. 13 having the handle lock engaged.

Referring now to FIG. 17, therein is shown an isometric view of the pair of pliers 1300 of FIG. 13 having the handle lock 1302 engaged. The handle lock 1302 can be a peg configured to slide through the small gear 130.

The lever fulcrum 126 is depicted as enlarged and sticking out of the side of the upper lever 122. On the far side of the upper lever 122, the lever fulcrum 126 and the handle lock 1302 are coupled together so as to allow the lever fulcrum 126 and the handle lock 1302 to move synchronously and perpendicular to the upper lever 122.

When the lever fulcrum 126 is pushed in so that it does not protrude on the near side of the upper lever 122 the handle lock 1302 will also be moved the same direction and out of engagement with the small gear 130. When the lever fulcrum 126 is pushed in on the near side the handle lock 1302 will not be engaged and the upper lever 122 will collapse as described above when a load is present on the work surface 110. When the handle lock 1302 is engaged with the small gear 130, the upper lever 122 will not collapse when a load is placed on the work surface 110.

Figure 18:
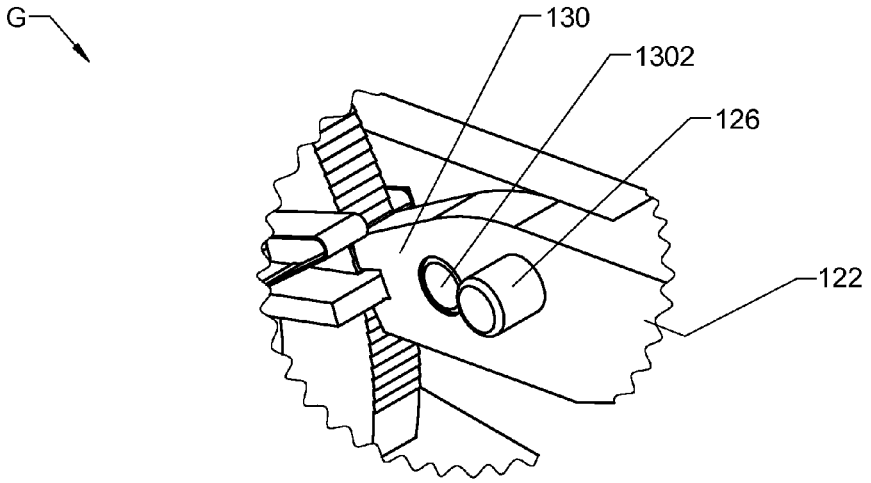
FIG. 18 is a detailed view of region G of FIG. 17.

Referring now to FIG. 18, therein is shown a detailed view of region G of FIG. 17. The handle lock 1302 is shown in greater detail.

The handle lock 1302 is depicted when engaged with the small gear 130 and the lever fulcrum 126 is shown protruding on the near side of the upper lever 122. In this configuration the upper lever 122 will be locked and will not collapse.

Figure 19:
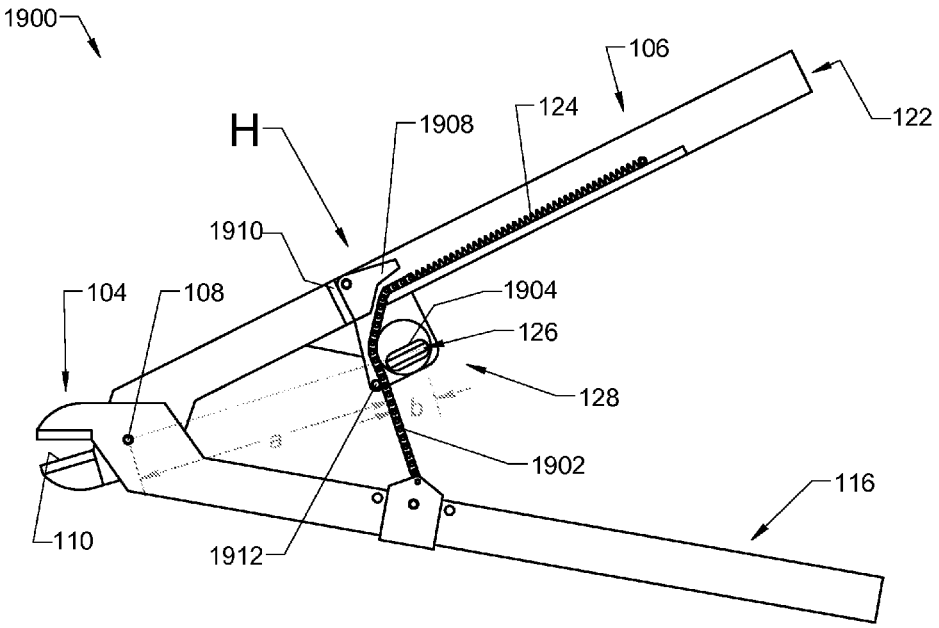
FIG. 19 is a side view of a cable drive pair of pliers in a fifth embodiment of the present invention not under load.

Referring now to FIG. 19, therein is shown a side view of a cable drive pair of pliers 1900 in a fifth embodiment of the present invention not under load. The pair of pliers 1900 is similar to the pair of pliers 100 of FIG. 1 but in a different configuration.

The pair of pliers 1900 includes the handles 106 and the jaws 104 pivoting about the pivot point 108. The jaws 104 are configured to act as snipers. The upper lever 122 is configured to collapse when a load is placed on the work surface 110 of the jaws 104.

The mechanism 128 of the present embodiment relies on a cable 1902 rather than the large gear 132 and small gear 130 of FIG. 1. When no load is present and the upper lever 122 is not collapsed, the cable 1902 is configured to slide freely over a selector 1904. The selector 1904 can rotate to vary the mechanical advantage available when the upper lever 122 collapses and the mechanism 128 engages.

The cable 1902 can be any suitable cable. In this embodiment, the cable 1902 is depicted as a chain. The cable 1902 is coupled on one end to the lower lever 116 and on the other end to the upper lever 122 through the load responsive component 124. The load responsive component 124 responds to loads placed on the work surface 110 and also ensures that the cable 1902 does not have any slack therein when the upper lever 122 moves closer or further from the lower lever 116.

The mechanism 128 is depicted in an unengaged configuration with the upper lever 122 not collapsed. In this configuration the cable 1902 can easily move relative to the selector 1904. A cable lock 1908 is held in an open position by a release tab 1910. The cable lock 1908 is held in the open position when the upper lever 122 is not collapsed.

When the upper lever 122 collapses and hinges about the lever fulcrum 126 of FIG. 1, the release tab 1910 will allow the cable lock 1908 to engage the cable 1902 and the cable 1902 will no longer freely move over the selector 1904 but instead will be forced to wrap around the selector 1904.

The lever fulcrum 126 can be located behind the selector 1904. The mechanical advantage of the upper lever 122 and the lower lever 116 pivoting on the pivot point 108 will be multiplied by "distance a" divided by a "distance b" (da)/(db).

The db can be defined in the present embodiment as the distance from the lever fulcrum 126 behind the selector 1904 to the edge of the selector 1904 in direct contact with the cable 1902. The da can be defined in the present embodiment as the distance from the pivot point 108 to the edge of the selector 1904 in direct contact with the cable 1902.

As the upper lever 122 collapses, the ratio of da/db changes as da becomes smaller and db greater thus gradually increasing the mechanical advantage. The mechanism 128 further includes a retention peg 1912 to keep the cable 1902 in place.

Figure 20:
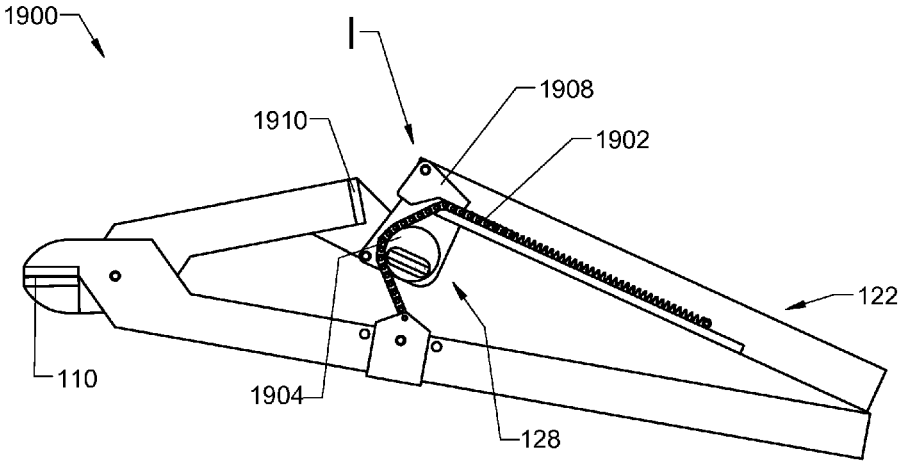
FIG. 20 is a side view of the pair of pliers of FIG. 19 under load.

Referring now to FIG. 20, therein is shown a side view of the pair of pliers 1900 of FIG. 19 under load. The upper lever 122 is shown collapsed As the upper lever 122 collapses the cable lock 1908 will move away from the release tab 1910 and engage the cable 1902, locking it in place. The cable 1902 can be depicted as wrapping around the selector 1904 to multiply the mechanical advantage of the pivot point 108 by the mechanism 128.

When the upper lever 122 returns to an uncollapsed state, the release tab 1910 will engage the cable lock 1908. When the release tab 1910 engages the cable lock 1908, the cable lock 1908 will release the cable 1902 and allow the cable 1902 to move freely over the selector 1904.

Figure 21:
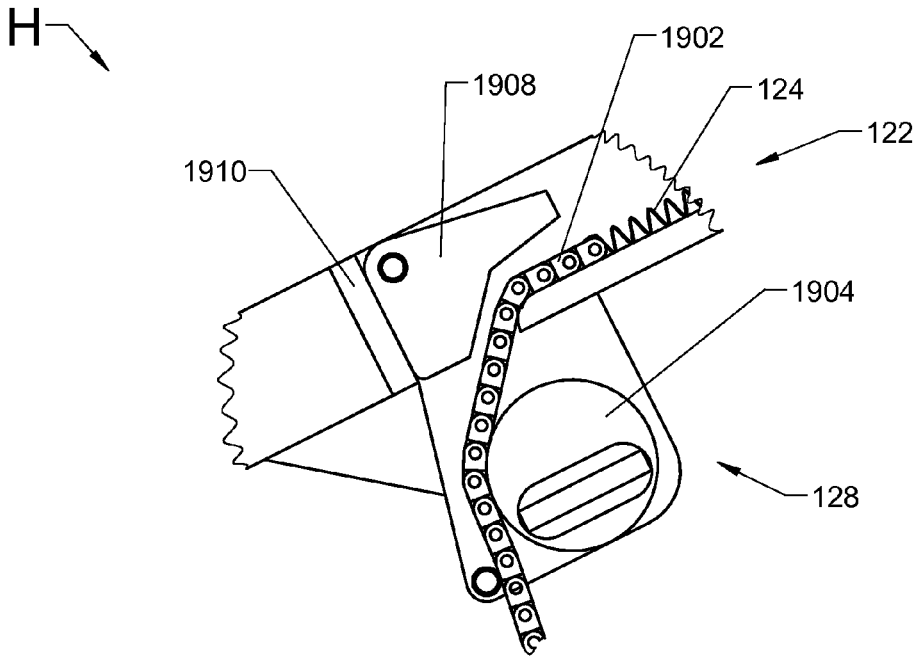
FIG. 21 is a detailed view of region H of FIG. 19.

Referring now to FIG. 21, therein is shown a detailed view of region H of FIG. 19. The mechanism 128 is shown in greater detail.

The cable lock 1908 can be seen in an open position by the release tab 1910 allowing the cable 1902 to move freely over the selector 1904. The cable 1902 is shown attached on one end to the load responsive component 124 to remove any slack from the cable 1902 and to keep the upper lever 122 straight.

Figure 22:
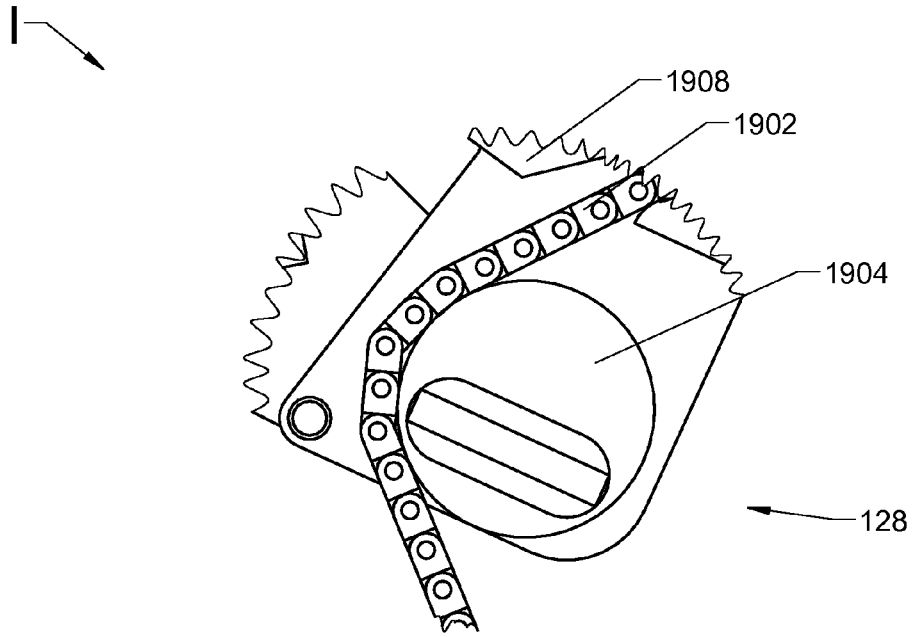
FIG. 22 is a detailed view of region I of FIG. 20.

Referring now to FIG. 22, therein is shown a detailed view of region I of FIG. 20. The mechanism 128 can be seen in greater detail and in an engaged state. The mechanism 128 is engaged when the cable lock 1908 forces the cable 1902 to wrap around the selector 1904 when the lever fulcrum 126 of FIG. 1 pivots.

Figure 23:
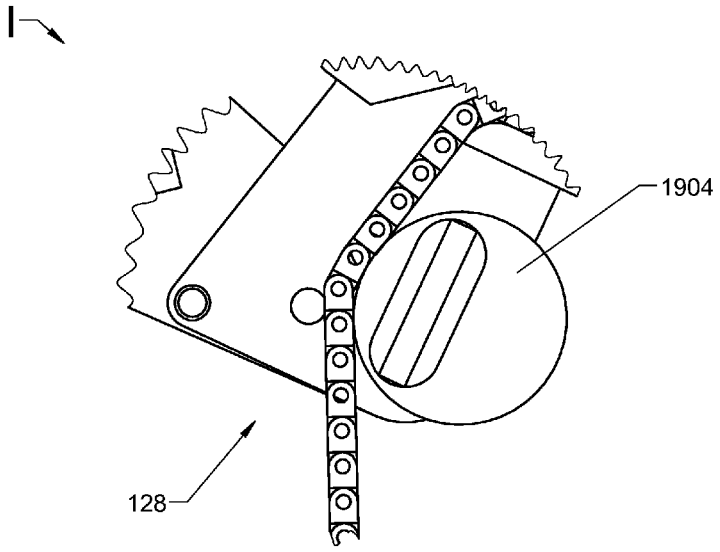
FIG. 23 is a detailed view of region I of FIG. 20 in an alternate setting.

Referring now to FIG. 23, therein is shown a detailed view of region I of FIG. 20 in an alternate setting. The selector 1904 is shown in a different position than the selector 1904 shown in FIG. 22. Changing the selector 1904 position can change the ratio of da/db generating the mechanical advantage of the mechanism 128.

Figure 24:
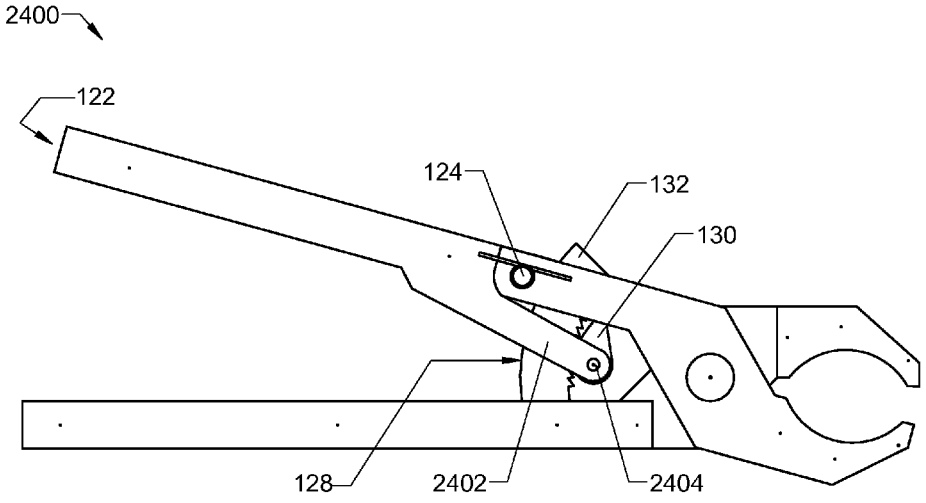
FIG. 24 is a side view of a curved jaw pair of pliers in a sixth embodiment of the present invention not under load.

Referring now to FIG. 24, therein is shown a side view of a curved jaw pair of pliers 2400 in a sixth embodiment of the present invention not under load. The pair of pliers 2400 is shown in a similar configuration to that of the pair of pliers 100 of FIG. 1

The mechanism 128 is shown having the small gear 130 and the large gear 132 in close proximity allowing the small gear 130 to move without engaging the large gear 132 as the upper lever 122 and the lower lever 116 move in relation to each other. The small gear 130 can be affixed to the upper lever 122 while the large gear 132 can be affixed to the lower lever 116.

The load responsive component 124 is shown keeping the upper lever 122 in a straight, uncollapsed position. The small gear 130 is supported by a support 2402 attached to the upper lever 122 at one end. The small gear 130 is attached to the support 2402 with a pivot 2404 allowing the small gear 130 to rotate once it is engaged with the large gear 132.

Figure 25:
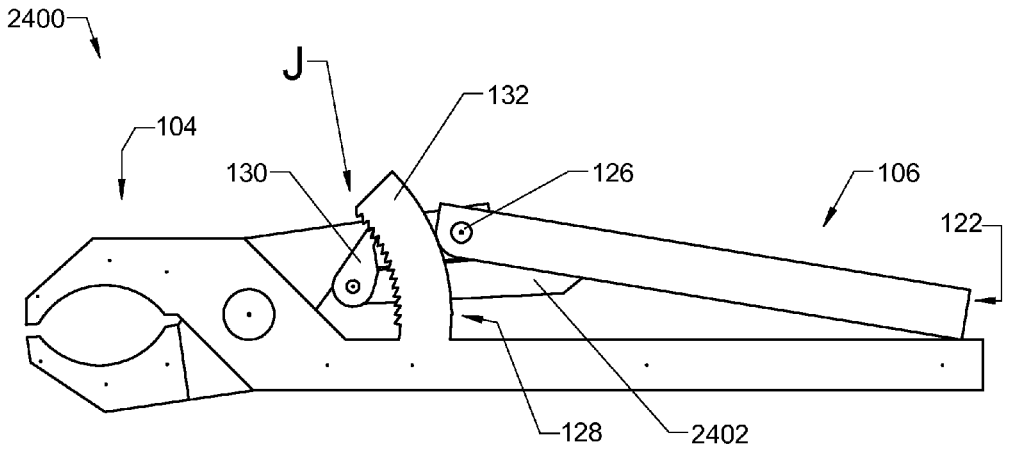
FIG. 25 is a side view of the pair of pliers of FIG. 24 under load.

Referring now to FIG. 25, therein is shown a side view of the pair of pliers 2400 of FIG. 24 under load. The mechanism 128 is engaged providing the small gear 130 meshed with the large gear 132.

The lever fulcrum 126 has allowed the upper lever 122 to collapse forcing the small gear 130 up toward the large gear 132 as the support 2402 collapses with the upper lever 122. As the small gear 130 meshes with the large gear 132, the handles 106 can be squeezed closer together. As the handles 106 move closer the small gear 130 will be forced up by the support 2402 and thereby, bring the jaws 104 closer together.

Figure 26:
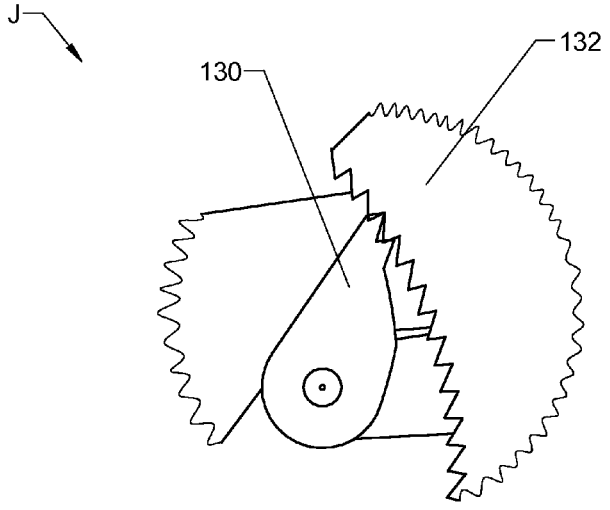
FIG. 26 is a detailed view of region J of FIG. 25.

Referring now to FIG. 26, therein is shown a detailed view of region J of FIG. 25. The small gear 130 is shown meshed with the large gear 132 when the upper lever 122 of FIG. 25 is in the collapsed state.

Figure 27:
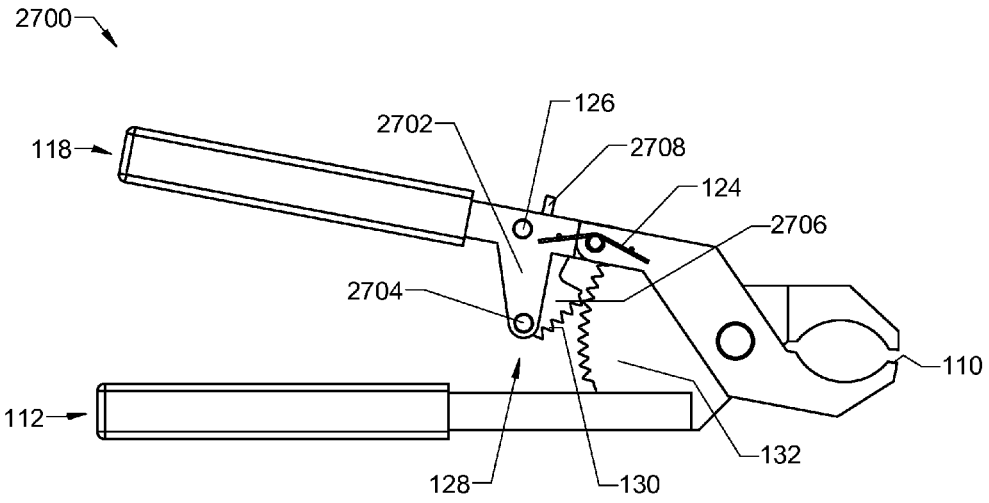
FIG. 27 is a side view of a geared pair of pliers in a seventh embodiment of the present invention not under load.

Referring now to FIG. 27, therein is shown a side view of a geared pair of pliers 2700 in a seventh embodiment of the present invention not under load. The pair of pliers 2700 is similar to the pair of pliers 100 of FIG. 1.

The pair of pliers 2700 is depicted having the lever fulcrum 126 within the upper handle 118. The lever fulcrum 126 is positioned above a strut 2702. The strut 2702 can extend partially down from the upper handle 118 toward the lower handle 112.

At the bottom portion of the strut 2702, the strut 2702 includes a strut fulcrum 2704 coupled to an engagement pad 2706. The engagement pad 2706 includes the small gear 130 and an engagement lever 2708.

The engagement lever 2708 allows the small gear 130 to engage the large gear 132 before a load, present on the work surfaces 110, is sufficient to deform the load responsive component 124. The engagement lever 2708 can also delay the engagement of the small gear 130 and the large gear 132 by a user. The engagement lever 2708 provides an alternative method to engage the mechanism 128 if a user chooses.

Figure 28:
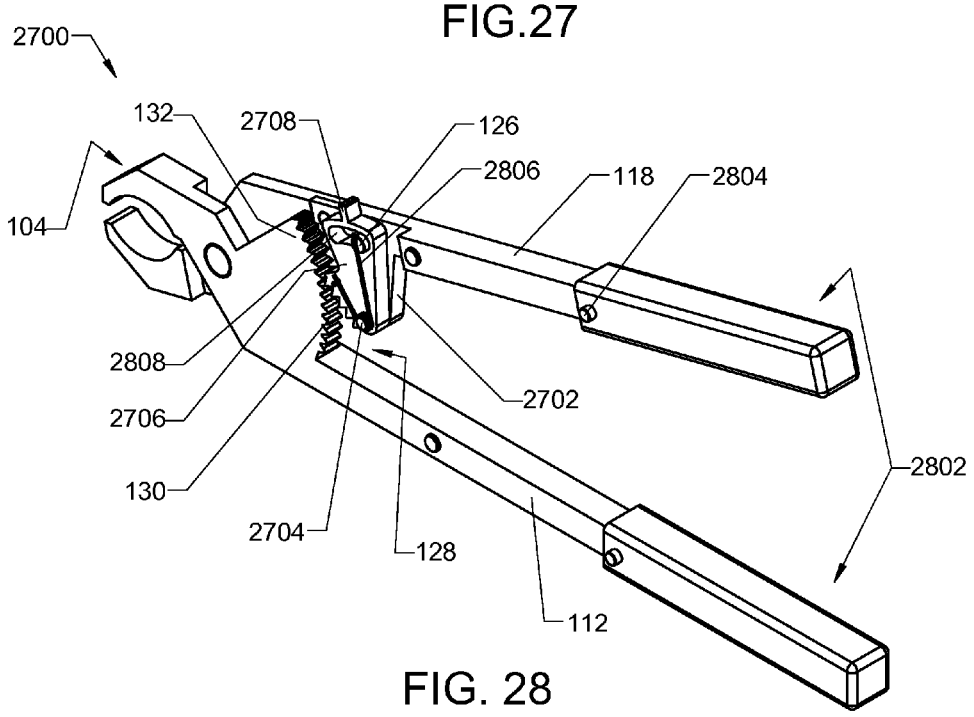
FIG. 28 is an isometric view of the pair of pliers of FIG. 27.

Referring now to FIG. 28, therein is shown an isometric view of the pair of pliers 2700 of FIG. 27 not under load. The pair of pliers 2700 is shown with the upper handle 118 and the lower handle 112 having telescopic handles 2802 that are in an extended position. The telescopic handles 2802 can be extended and locked into position with an extension lock 2804.

The engagement pad 2706 is shown attached to the strut 2702 with the strut fulcrum 2704. Coupled to the strut fulcrum 2704 and around the strut fulcrum 2704 is an engagement spring 2806. The engagement spring 2806 resists engagement by the engagement lever 2708 until the engagement spring 2806 can be deformed by force placed upon the engagement lever 2708.

When the load responsive component 124 of FIG. 27 deforms in the presence of a load, the small gear 130 will engage with the large gear 132 and deform the engagement spring 2806. When the small gear 130 engages with the large gear 132, the engagement pad 2706 will bring the small gear 130 substantially parallel or tangential to the large gear 132 by pivoting on the strut fulcrum 2704 and deforming the engagement spring 2806.

As the engagement pad 2706 pivots on the strut fulcrum 2704, the upper portion of the engagement pad 2706 near the engagement lever 2708 will move relative to a handle pin 2808. The handle pin 2808 can extended toward the engagement pad 2706 and extend through an engagement pad slot 2810 within the engagement pad 2706. The engagement pad 2706 can slide along the handle pin 2808 riding within the engagement pad slot 2810.

Before the mechanism 128 engages, the handle pin 2808 can be near an edge of the engagement pad slot 2810 furthest from the jaws 104. As the mechanism 128 is engaged, the engagement pad 2706 will pivot on the strut fulcrum 2704 and the engagement pad 2706 will move relative to the handle pin 2808 resulting in the handle pin 2808 being positioned near the middle or opposite end of the engagement pad slot 2810.

Figure 29:
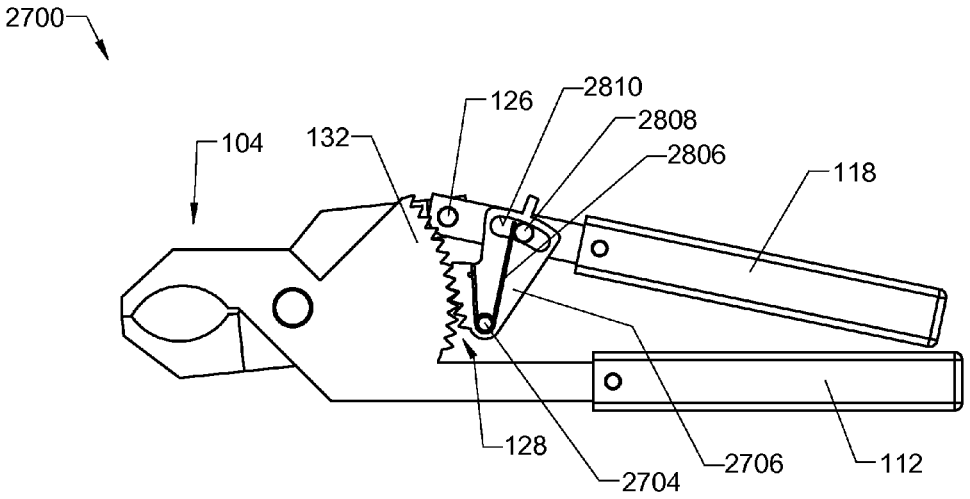
FIG. 29 is a side view of the pair of pliers of FIG. 27 under load.

Referring now to FIG. 29, therein is shown a side view of the pair of pliers 2700 of FIG. 27 under load. The upper handle 118 is shown collapsed about the lever fulcrum 126. As the upper handle 118 is collapsed, the mechanism 128 is engaged and the engagement pad 2706 is pivoted about the strut fulcrum 2704 and the engagement spring 2806 is compressed.

The handle pin 2808 is shown in the middle of the engagement pad slot 2810 and can move relative to the engagement pad slot 2810 as the upper handle 118 and the lower handle 112 are moved relative to one another. The engagement pad slot 2810 of the engagement pad 2706 can slide along the handle pin 2808 and as the engagement pad 2706 is engaged with the large gear 132, the engagement pad slot 2810 will move closer to an edge near the jaws 104. The force required to engage the mechanism 128 is the combination of the force required to deform the load responsive component 124 of FIG. 28 and all or a portion of the force required to deform the engagement spring 2806.

Figure 30:
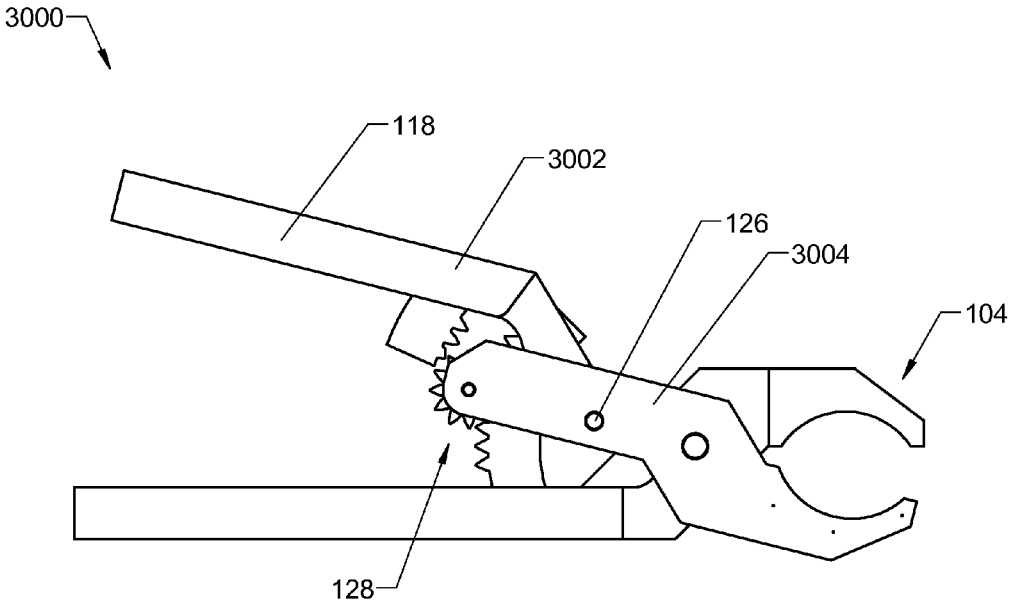
FIG. 30 is a side view of a geared pair of pliers in an eighth embodiment of the present invention not under load.

Referring now to FIG. 30, therein is shown a side view of a geared pair of pliers 3000 in an eighth embodiment of the present invention not under load. The pair of pliers 3000 is similar to the pair of pliers 100 of FIG. 1.

The pair of pliers 3000 is depicted having the upper handle 118 in a bifurcated state with a proximal portion 3002 and a distal portion 3004. The proximal portion 3002 is shown substantially parallel to the distal portion 3004 and overlapping the distal portion 3004 along a vertical axis.

The proximal portion 3002 and the distal portion 3004 are connected by the lever fulcrum 126. When no load is placed on the jaws 104, the proximal portion 3002 and the distal portion 3004 are substantially parallel. As a load is placed on the jaws 104, the distal portion 3004 and the proximal portion 3002 collapse and pivot about the lever fulcrum 126. When the upper handle 118 collapses, the mechanism 128 engages.

Figure 31:
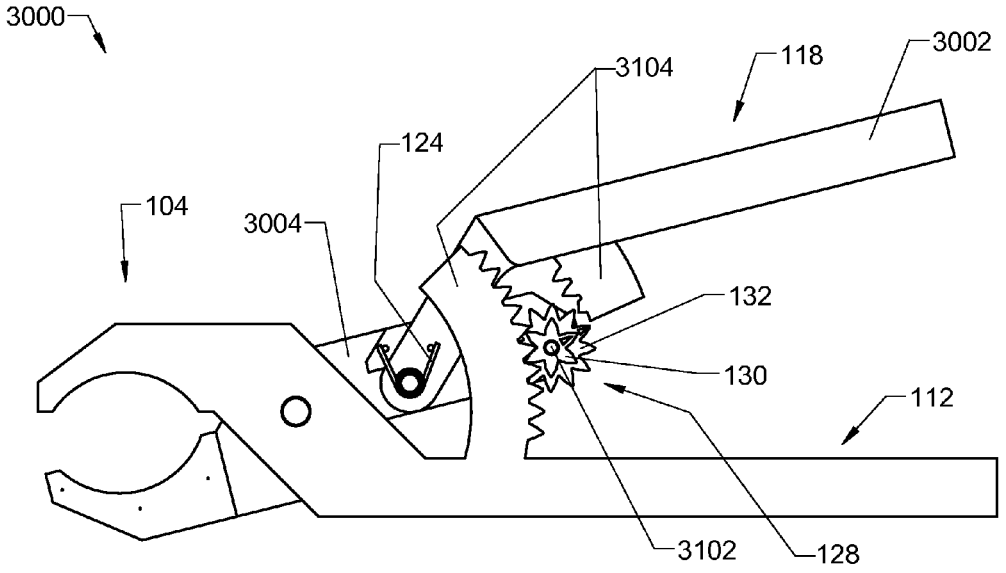
FIG. 31 is a side view of the pair of pliers of FIG. 30.

Referring now to FIG. 31, therein is shown a side view of the pair of pliers of FIG. 30 not under load. The pair of pliers 3000 is shown having the distal portion 3004 and the proximal portion 3002 of the upper handle 118 substantially parallel. The load responsive component 124 is shown in a non-deformed state. The load responsive component 124 is shown resisting a stretching force but it is contemplated in other embodiments that the load responsive component 124 can resist compressive forces as well.

The mechanism 128 is shown having the large gear 132 and the small gear 130 fixed in relation to each other. The small gear 130 and the large gear 132 are fixed in relation to each other and rotate about a gear pin 3102. The small gear 130 rotates about the gear pin 3102 and engages a geared strut 3104 coupled to the lower handle 112.

When the jaws 104 are manipulated to move them together and apart, the small gear 130 will engage the geared strut 3104 attached to the lower handle 112 and rotate about the gear pin 3102. The large gear 132 does not engage the geared strut 3104 attached to the upper handle 118 until a load is placed on the jaws 104 sufficient to deform the load responsive component 124.

Figure 32:
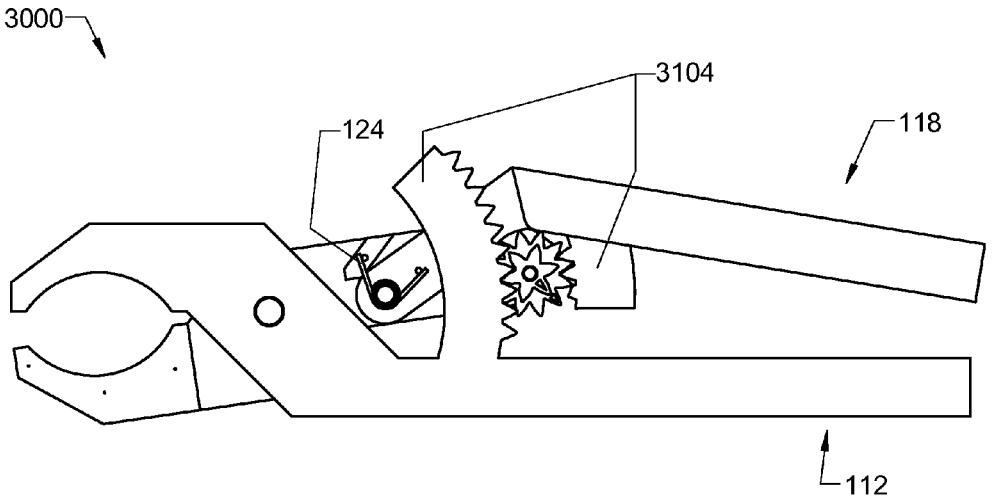
FIG. 32 is a side view of the pair of pliers of FIG. 30 under load.

Referring now to FIG. 32, therein is shown a side view of the pair of pliers of FIG. 30 under load. The pair of pliers 3000 is shown with the geared strut 3104 coupled to the upper handle 118 and the geared strut 3104 coupled to the lower handle 112 engaged with the large gear 132 and the small gear 130, respectively, because the load responsive component 124 is deformed and the upper handle 118 has collapsed. As can be seen, the large gear 132 and the small gear 130 are still fixed in relation to each other.

Figure 33:
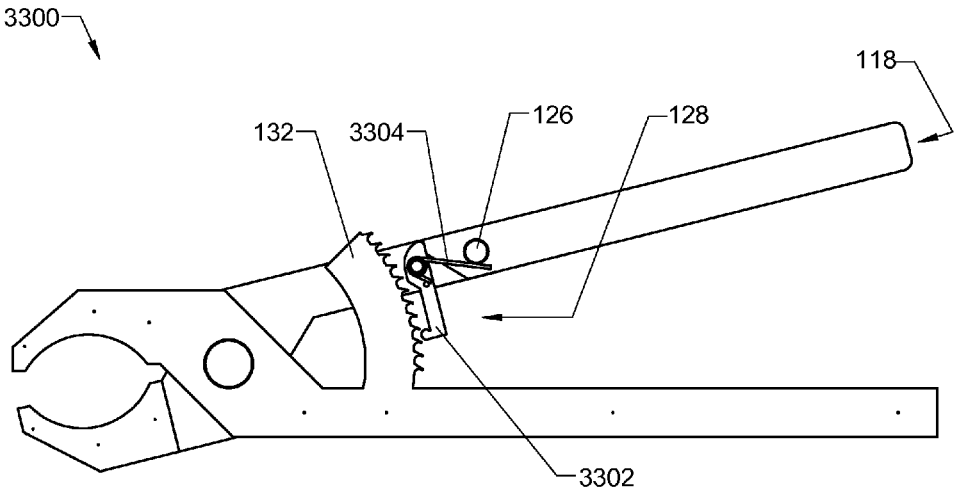
FIG. 33 is a side view of a ratchet pair of pliers in a ninth embodiment of the present invention not under load.

Referring now to FIG. 33, therein is shown a side view of a ratchet pair of pliers 3300 in a ninth embodiment of the present invention not under load. The pair of pliers 3300 is similar to the pair of pliers 100 of FIG. 1.

The pair of pliers 3300 can be depicted having the upper handle 118 having the lever fulcrum 126 in an uncollapsed state. The upper handle 118 is further coupled to the load responsive component 124 of FIG. 1 but not depicted in the present side view. The pair of pliers 3300 differs from the pair of pliers 100 in that the large gear 132 is opposite and faces a ratchet 3302.

The ratchet 3302 can move independently of the large gear 132 when the upper handle 118 is in an uncollapsed state. The ratchet 3302 is held away from the large gear 132 with a retaining spring 3304.

The retaining spring 3304 is coupled to the upper handle 118 and to the ratchet 3302. The ratchet 3302 can be coupled to a portion of the upper handle 118 that extends beyond the lever fulcrum 126 on two sides allowing for force multiplication using the lever fulcrum 126 as a pivot point.

The ratchet 3302 is coupled to the upper handle 118 nearer to the large gear 132 on the upper handle 118 allowing for the ratchet 3302 to produce force multiplication when engaged with the large gear 132. The ratchet 3302, upper handle 118, and large gear 132 comprise the mechanism 128.

Figure 34:
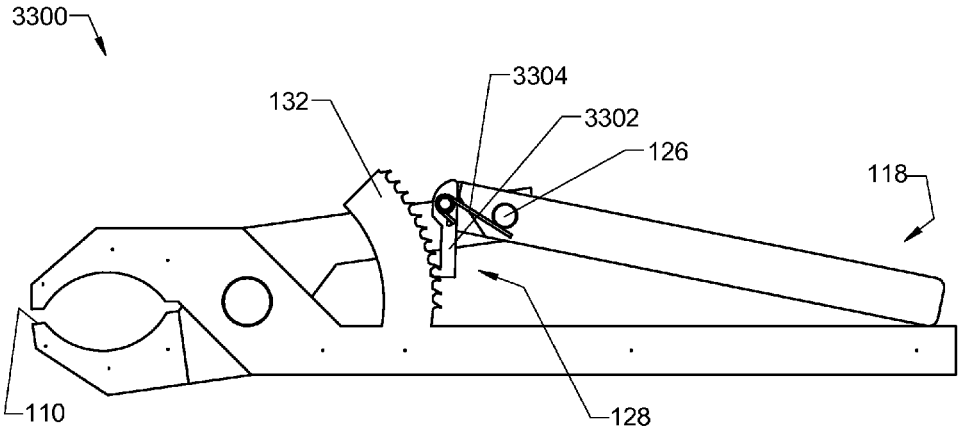
FIG. 34 is a side view of the pair of pliers of FIG. 33 under load.

Referring now to FIG. 34, therein is shown a side view of the pair of pliers of FIG. 33 under load. The pair of pliers 3300 is shown with the upper handle 118 in a collapsed state having the ratchet 3302 engaged with the large gear 132 and the retaining spring 3304 compressed. The ratchet 3302 is moved toward the large gear 132 as the upper handle 118 collapses about the lever fulcrum 126 when a load is present on the work surface 110.

Referring now to the mechanism system of FIGS. 1-34, the mechanism system has been shown implementing the mechanism 128 along with the load responsive component 124 and other elements within various forms of pliers; however, it is contemplated that the mechanism system of the present invention may be implemented in many other applications. Other applications can include robotic devices, medical devices, car jacks, heavy machinery, jaws-of-life, and micro-electromechanical systems. It is also contemplated that the movement or engagement of the mechanism 128 is not required to be limited to the embodiments described above since those of ordinary skill in the art would recognize that engagement of the mechanism 128 can arise from movement about different axis, such as rotation about the cross-section of the upper lever 122, or other movements.

Thus, it has been discovered that the mechanism system of the present invention furnish important and heretofore unknown and unavailable solutions, capabilities, and functional aspects.

The resulting configurations are straightforward, cost-effective, uncomplicated, highly versatile, accurate, sensitive, and effective, and can be implemented by adapting known components for ready, efficient, and economical manufacturing, application, and utilization.

While the invention has been described in conjunction with a specific best mode, it is to be understood that many alternatives, modifications, and variations will be apparent to those skilled in the art in light of the preceding description.

Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A tool comprising:

a first jaw arrangement including a first jaw member, a first gear segment, and a first handle;

a second jaw arrangement including a second jaw member, a second handle, a second gear segment fixedly attached to the second handle and a spring;

a first pivot member pivotally connecting the first jaw member and the second jaw member; and a second pivot member pivotally connecting the second jaw member directly to the second handle and second gear segment, the teeth of the second gear segment configured to rotate about the second pivot member;

wherein the spring is configured to bias the second handle to rotate about the second pivot member in a second rotational direction opposite the first rotational direction, away from the first handle and is thereby configured to disengage the second gear member from the first gear member when a force applied between the jaws is below a threshold; and wherein the spring is configured to deform when a force applied between the laws is above the threshold, thereby causing the second handle to pivot about the second pivot member toward the first handle wherein the first and second gear members are configured to engage each other in an engaged configuration and are thereby configured to transform a handle force applied on the second handle to a jaw force at the second jaw member through the meshed first and second gear members.

2. The tool of claim 1, wherein the disengaged configuration creates a first ratio of movement between the second jaw member and the second handle, and wherein the engaged configuration creates a second ratio of movement between the second jaw member and the second handle different from the first ratio of movement.

3. The tool of claim 1, wherein the first jaw member, the first gear segment, and the first handle rigidly coupled with each other.

4. A tool comprising:

a first and a second jaw members pivotally connected by a first pivot point for movement toward and away from one another;

a first lever consisting of a first handle rigidly coupled with the first jaw member, the first jaw member is formed with a first gear segment configured to rotate about the first pivot point;

a collapsible lever, comprised of a second handle, a second gear segment, a spring, a second pivot point and the second jaw member;

the second jaw member is fixedly coupled with the second pivot point;

the second handle is rigidly coupled with the second gear segment, and separate from the second jaw member, pivotally mounted on the second pivot point at one end thereof adjacent the first gear segment, with the second gear segment being configured to rotate about the second pivot point and adapted to optionally mesh with the first gear segment;

a surface on the second jaw member configured for engagement with respective first and second surfaces on the second handle to limit a maximum and a minimum pivot positions of the second handle about the second pivot point relative to the second jaw member, configuring an uncollapsed and a collapsed state;

the uncollapsed state is created when the second handle is at the maximum pivot position, the second handle is fully extended away from the second jaw member, the first and the second gear segments are disengaged from one another;

the collapsed state is created when the second handle is rotated toward the second jaw out of the maximum pivot position such that the first and the second gear segments are engaged with each other;

wherein the spring is configured to continuously bias and push the second handle toward the maximum pivot position when the force on to the second handle towards the first handle is less than the biasing force of the spring; and wherein the spring is configured to deform when pressure applied on the second handle towards the first handle and opposing resistance present between the first and the second jaw members exceeds the biasing force of the spring causing the second handle to pivot about the second pivot point out of the maximum pivot position.

5. The tool of claim 4, wherein the first gear segment is a partial gear with teeth evenly spaced about an arc; wherein the second gear segment is a circular segment with teeth evenly spaced about an arc.

6. The tool of claim 4, wherein the uncollapsed state provides a first ratio of movement of the second handle relative to the first and the second jaw members; and wherein the collapsed state provides a second ratio of movement of the second handle relative to the first and the second jaw members.

* * * * *